US008526871B2

(12) United States Patent
Yoshikawa

(10) Patent No.: US 8,526,871 B2
(45) Date of Patent: Sep. 3, 2013

(54) FIXING DEVICE AND IMAGE FORMING APPARATUS INCORPORATING SAME

(71) Applicant: Takahiro Yoshikawa, Sagamihara (JP)

(72) Inventor: Takahiro Yoshikawa, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/717,844

(22) Filed: Dec. 18, 2012

(65) Prior Publication Data

US 2013/0108336 A1 May 2, 2013

Related U.S. Application Data

(62) Division of application No. 12/714,812, filed on Mar. 1, 2010, now Pat. No. 8,358,959.

(30) Foreign Application Priority Data

Mar. 5, 2009 (JP) ..... 2009-051583
Mar. 13, 2009 (JP) ..... 2009-060631

(51) Int. Cl.
*G03G 15/20* (2006.01)

(52) U.S. Cl.
USPC ..... 399/329

(58) Field of Classification Search
USPC ..... 399/329, 331, 323; 219/216, 469–471
See application file for complete search history.

(56) References Cited

U.S. PATENT DOCUMENTS 4,715,597 A * 12/1987 Sakurai
5,708,926 A 1/1998 Sagara et al.
5,758,245 A 5/1998 Matsuura et al.
5,926,680 A 7/1999 Yamamoto et al.
6,088,558 A 7/2000 Yamada et al.
6,091,926 A 7/2000 Yamada
6,243,559 B1 * 6/2001 Kurotaka et al. ..... 399/329
6,263,172 B1 7/2001 Suzuki et al.
6,351,619 B1 2/2002 Yamada
6,501,935 B2 * 12/2002 Hirai et al. ..... 399/329

(Continued)

FOREIGN PATENT DOCUMENTS

JP 10-312132 11/1998
JP 2000-172103 6/2000

(Continued)

OTHER PUBLICATIONS

Office Action issued Jan. 15, 2013 in Japanese Patent Application No. 2009-051583.

*Primary Examiner* — Susan Lee
(74) *Attorney, Agent, or Firm* — Oblon, Spivak, McClelland, Maier & Neustadt, L.L.P.

(57) ABSTRACT

The fixing device includes a fixing roller, a separation roller, an endless fixing belt, and a pressing roller. The fixing roller includes a first elastic layer as a surface layer and has a roller hardness A. The separation roller includes a second elastic layer as a surface layer and has a roller hardness B smaller than the roller hardness A of the fixing roller. The endless fixing belt is wound around the fixing roller and the separation roller. The pressing roller is pressed against the fixing roller and the separation roller via the fixing belt to form a nip portion between the fixing belt and the pressing roller through which the recording medium bearing the toner image passes. The pressing roller includes a third elastic layer as a surface layer and has a roller hardness C not smaller than the roller hardness A of the fixing roller.

11 Claims, 25 Drawing Sheets

(56) References Cited

U.S. PATENT DOCUMENTS

| | | | | |
|---|---|---|---|---|
| 6,553,204 | B1 | 4/2003 | Yamada | |
| 6,577,840 | B2 | 6/2003 | Hachisuka et al. | |
| 6,865,363 | B2 * | 3/2005 | Hachisuka et al. | 399/329 |
| 6,925,280 | B2 | 8/2005 | Yamada | |
| 7,218,884 | B2 * | 5/2007 | Miyazaki | 219/216 |
| 7,228,096 | B2 | 6/2007 | Yamada | |
| 7,327,979 | B2 * | 2/2008 | Katayanagi | 399/329 |
| 7,359,664 | B2 | 4/2008 | Yamada | |
| 2008/0080909 | A1 | 4/2008 | Yamada | |
| 2008/0101813 | A1 | 5/2008 | Maui et al. | |
| 2009/0003897 | A1 | 1/2009 | Yamada | |
| 2010/0008683 | A1 | 1/2010 | Yoshikawa | |

FOREIGN PATENT DOCUMENTS

| | | | |
|---|---|---|---|
| JP | 2000-305403 | | 11/2000 |
| JP | 2003-302858 | A | 10/2003 |
| JP | 2003-330295 | | 11/2003 |
| JP | 2004-302488 | | 10/2004 |
| JP | 2004-309875 | | 11/2004 |
| JP | 2004-341346 | | 12/2004 |
| JP | 2006-71921 | | 3/2006 |
| JP | 3795758 | | 4/2006 |
| JP | 2007-163946 | | 6/2007 |
| JP | 4041728 | | 11/2007 |
| JP | 2008-185682 | | 8/2008 |
| JP | 2008-209515 | A | 9/2008 |
| JP | 2009-075167 | A | 4/2009 |

* cited by examiner

FIXING DEVICE AND IMAGE FORMING APPARATUS INCORPORATING SAME

CROSS-REFERENCE TO RELATED APPLICATIONS

This application is a Division of and claims the benefit of priority under 35 U.S.C. §120 from U.S. Ser. No. 12/714,812, filed Mar. 1, 2010 and claims priority to Japanese Patent Application Nos. 2009-060631, filed on Mar. 13, 2009, and 2009-051583, filed on Mar. 5, 2009, in the Japan Patent Office, each of which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing roller, a fixing belt wound around the fixing roller, and a pressing roller pressed against the fixing roller via the fixing belt to form a nip portion between the fixing belt and the pressing roller through which a sheet bearing a toner image passes. The fixing belt and the pressing roller apply heat and pressure to the sheet bearing the toner image as the sheet passes through the nip portion to fix the toner image on the sheet. Thereafter, the sheet bearing the fixed toner image is separated from the fixing belt and the pressing roller by a separator contacting the fixing belt, and conveyed to the outside of the image forming apparatus.

However, the separator that contacts the fixing belt to separate the sheet bearing the fixed toner image from the fixing belt is capable of scratching and damaging the fixing belt. When the damaged fixing belt contacts the fixed toner image on the sheet, especially a glossy color toner image, scratches on the fixing belt may spoil the image. To address this problem, a non-contact separator may be provided to separate the sheet bearing the fixed toner image from the fixing belt without contacting the fixing belt. However, in this case, the fixing belt is required to have a greater-than-usual degree of curvature to facilitate separation of the sheet from the fixing belt.

On the other hand, increasing demand for high-speed toner image formation requires that the nip portion formed between the fixing belt and the pressing roller have a greater length in a sheet conveyance direction, so that sufficient heat and pressure can be applied to the sheet to securely fix the toner image even when the fixing belt and the pressing roller rotate at faster speeds.

To address such requirements, the fixing belt may be wound around a plurality of rollers to provide the greater curvature required to facilitate separation of the sheet from the fixing belt and the greater length of the nip portion. For example, a separation roller may be provided downstream from the nip portion formed between the fixing roller and the pressing roller in the sheet conveyance direction, and pressed against the pressing roller via the fixing belt to form a second nip portion between the separation roller and the pressing roller. Thus, the first nip portion formed between the fixing roller and the pressing roller and the second nip portion formed between the separation roller and the pressing roller provide the greater nip length needed to apply sufficient heat and pressure to the sheet. Also, the fixing belt wound around the fixing roller and the separation roller provides the greater curvature to facilitate separation of the sheet from the fixing belt.

However, there are drawbacks to the above-described configuration. For example, at an intermediate nip portion provided between the first nip portion and the second nip portion in the sheet conveyance direction, the fixing belt may not be pressed against the pressing roller properly, and may separate from the pressing roller. Further, a circumferential velocity of the fixing belt may differ from a circumferential velocity of the pressing roller due to reduced friction between the fixing belt and the pressing roller at the intermediate nip portion. Consequently, the fixing belt may become slack or slip, resulting in formation of a faulty toner image.

BRIEF SUMMARY OF THE INVENTION

This specification describes below a fixing device according to exemplary embodiments of the present invention. In one exemplary embodiment of the present invention, the fixing device fixes a toner image on a recording medium, and includes a fixing roller, a separation roller, an endless fixing belt, a pressing roller, a first driving system, and a second driving system. The separation roller is provided downstream from the fixing roller in a recording medium conveyance direction. The fixing belt is wound around at least the fixing roller and the separation roller. The pressing roller is pressed against the fixing roller and the separation roller via the fixing belt to form a first nip portion between the fixing belt and the pressing roller through which the recording medium bearing the toner image passes. The first driving system is connected to the fixing roller and the separation roller, and includes a first motor and a first transmission. The first motor generates a first driving force. The first transmission transmits the first driving force to the fixing roller and the separation roller, and includes a first one-way clutch via which the first driving force is transmitted to the fixing roller. The second driving system is connected to the pressing roller, and includes a second motor and a second transmission. The second motor generates a second driving force. The second transmission transmits the second driving force to the pressing roller. When a circumferential velocity of the pressing roller is greater than a circumferential velocity of the fixing roller, the first one-way clutch idles to allow rotation of the fixing roller in accordance with rotation of the pressing roller.

This specification describes below an image forming apparatus according to exemplary embodiments of the present invention. In one exemplary embodiment of the present invention, the image forming apparatus includes a fixing device for fixing a toner image on a recording medium. The fixing device includes a fixing roller, a separation roller, an endless fixing belt, a pressing roller, a first driving system, and a second driving system. The separation roller is provided downstream from the fixing roller in a recording medium conveyance direction. The fixing belt is wound around at least the fixing roller and the separation roller. The pressing roller is pressed against the fixing roller and the separation roller via the fixing belt to form a first nip portion between the fixing belt and the pressing roller through which the recording medium bearing the toner image passes. The first driving system is connected to the fixing roller and the separation roller, and includes a first motor and a first transmission. The first motor generates a first driving force. The first transmission transmits the first driving force to the fixing roller and the separation roller, and includes a first one-way clutch via which the first driving force is transmitted to the fixing roller. The second driving system is connected to the pressing roller, and includes a second motor and a second transmission. The second motor generates a second driving force. The second transmission transmits the second driving force to the pressing roller. When a circumferential velocity of the pressing roller is greater than a circumferential velocity of the fixing roller, the first one-way clutch idles to allow rotation of the fixing roller in accordance with rotation of the pressing roller.

This specification describes below a fixing device according to exemplary embodiments of the present invention. In one exemplary embodiment of the present invention, the fixing device fixes a toner image on a recording medium, and includes a fixing roller, a separation roller, an endless fixing belt, and a pressing roller. The fixing roller includes a first elastic layer as a surface layer and has a roller hardness A. The separation roller is provided downstream from the fixing roller in a recording medium conveyance direction, and has a diameter smaller than a diameter of the fixing roller. The separation roller includes a second elastic layer as a surface layer and has a roller hardness B smaller than the roller hardness A of the fixing roller. The fixing belt is wound around at least the fixing roller and the separation roller. The pressing roller is pressed against the fixing roller and the separation roller via the fixing belt to form a nip portion between the fixing belt and the pressing roller through which the recording medium bearing the toner image passes. The pressing roller includes a third elastic layer as a surface layer and has a roller hardness C not smaller than the roller hardness A of the fixing roller.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
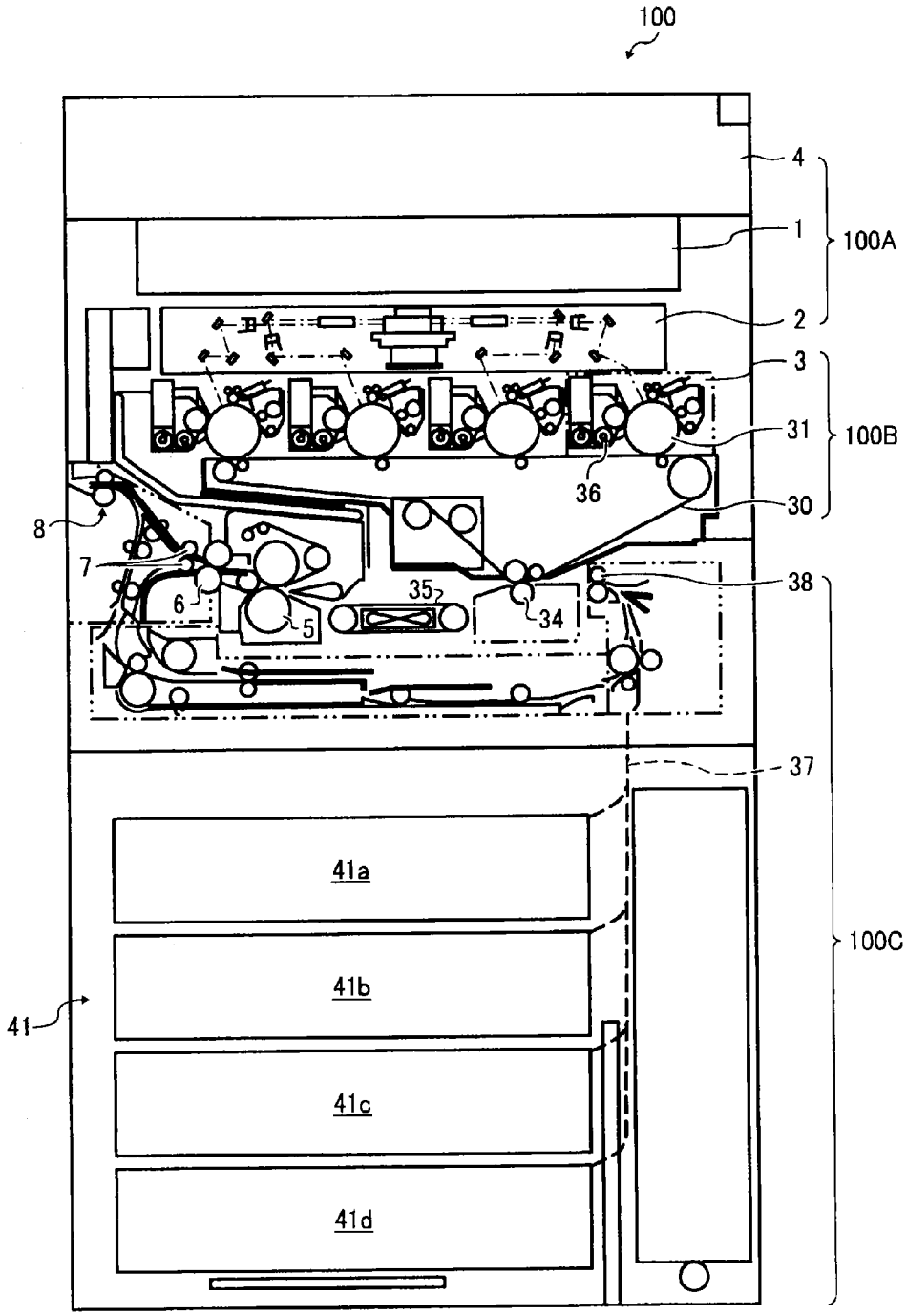
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic view of the image forming apparatus 100. As illustrated in FIG. 1, the image forming apparatus 100 includes an image reading portion 100A, an image forming portion 100B, and a sheet supply portion 100C.

The image reading portion 100A includes a scanner 1 and an auto document feeder (ADF) 4.

The image forming portion 100B includes a writer 2, a development device 3, a fixing device 5, a gloss finisher 6, a conveyance roller pair 7, an output device 8, an intermediate transfer member 30, photoconductors 31, a second transfer device 34, a conveyance belt 35, and a cleaner 36.

The sheet supply portion 100C includes a conveyance path 37, a registration device 38, and a sheet container 41. The sheet container 41 includes trays 41*a*, 41*b*, 41*c*, and 41*d*.

As illustrated in FIG. 1, the image forming apparatus 100 can be a copier, a facsimile machine, a printer, a multifunction printer having at least one of copying, printing, scanning, plotter, and facsimile functions, or the like. According to this exemplary embodiment of the present invention, the image forming apparatus 100 functions as a digital color copier for forming a color image on a recording medium.

The image reading portion 100A is provided in an upper portion of the image forming apparatus 100. The image forming portion 100B is provided in a center portion of the image forming apparatus 100. The sheet supply portion 100C is provided in a lower portion of the image forming apparatus 100.

In the image reading portion 100A, the ADF 4 loads a plurality of originals and feeds the originals successively toward the scanner 1. The scanner 1 optically reads an image on the original to generate image data.

In the image forming portion 100B, the intermediate transfer member 30 has a belt shape and includes a transfer surface extending in a horizontal direction. A mechanism for forming images in complementary colors for color separation is provided above the intermediate transfer member 30. Specifically, the four photoconductors 31 serving as image carriers for carrying toner images in complementary colors (e.g., yellow, magenta, cyan, and black) are arranged along the transfer surface of the intermediate transfer member 30.

The writer 2 is provided above the photoconductors 31, and emits light beams onto surfaces of the photoconductors 31 according to the image data generated by the scanner 1 or image data sent from an external device so as to form electrostatic latent images on the surfaces of the photoconductors 31, respectively. The photoconductors 31 include drums rotatable counterclockwise in FIG. 1 in an identical direction, respectively. A charger, the development device 3, a first transfer device, and the cleaner 36 surround the photoconductor 31 to form a toner image while the photoconductor 31 rotates. Specifically, the charger charges the surface of the photoconductor 31. The writer 2 emits a light beam onto the charged surface of the photoconductor 31 to form an electrostatic latent image on the photoconductor 31. The development device 3 develops the electrostatic latent image into a toner image. The first transfer device transfers the toner image formed on the photoconductor 31 onto the intermediate transfer member 30. The cleaner 36 collects residual toner from the surface of the photoconductor 31 after the toner image is transferred from the photoconductor 31 onto the intermediate transfer member 30. The four development devices 3 contain yellow, magenta, cyan, and black toners, respectively.

The intermediate transfer member 30 is wound around a driving roller and driven rollers, and opposes the photoconductors 31 to move in an identical direction with the photoconductors 31. The second transfer device 34 includes a transfer roller opposing one of the driven rollers. The conveyance belt 35, the fixing device 5, the gloss finisher 6, and the conveyance roller pair 7 are disposed in a sheet conveyance path extending from the second transfer device 34 in this order in a sheet conveyance direction.

In the sheet supply portion 100C, the sheet container 41 includes the trays 41*a*, 41*b*, 41*c*, and 41*c* for loading and containing sheets serving as recording media. A conveyance device includes the conveyance path 37 and the registration device 38. The conveyance device feeds the sheets loaded on the tray 41*a*, 41*b*, 41*c*, or 41*d* one by one through the conveyance path 37 toward the second transfer device 34 via the registration device 38 by separating an uppermost sheet from other sheets loaded on the tray 41*a*, 41*b*, 41*c*, or 41*d*. The registration device 38 corrects skew of the sheet sent from the tray 41*a*, 41*b*, 41*c*, or 41*d*, and feeds the sheet to the second transfer device 34 at a proper time at which a color toner image formed on the intermediate transfer member 30 is transferred onto the sheet.

The following describes an image forming operation performed in the image forming apparatus 100. The chargers uniformly charge the surfaces of the photoconductors 31, respectively. The writer 2 emits light beams onto the charged surfaces of the photoconductors 31 according to image data generated by the scanner 1 or image data sent from an external device to form electrostatic latent images corresponding to yellow, magenta, cyan, and black colors, respectively. The development devices 3 containing yellow, magenta, cyan, and black toners make the electrostatic latent images visible as yellow, magenta, cyan, and black toner images, respectively. The first transfer devices applied with a predetermined bias transfer the yellow, magenta, cyan, and black toner images onto the intermediate transfer member 30, respectively. Specifically, the yellow, magenta, cyan, and black toner images are successively superimposed on a same position on the intermediate transfer member 30 by an electrostatic force to form a color toner image on the intermediate transfer member 30.

The second transfer device 34 transfers the color toner image formed on the intermediate transfer member 30 onto a sheet sent from the tray 41*a*, 41*b*, 41*c*, or 41*d* of the sheet container 41. The conveyance belt 35 conveys the sheet bearing the color toner image to the fixing device 5. The fixing device 5 fixes the color toner image on the sheet. The gloss finisher 6 adds gloss to the fixed color toner image on the sheet as needed. The conveyance roller pair 7 feeds the sheet bearing the fixed color toner image to the output device 8. The output device 8 conveys the sheet bearing the fixed color toner image through an output path to an outside of the image forming apparatus 100. Thus, a series of image forming processes is finished.

Figure 2:
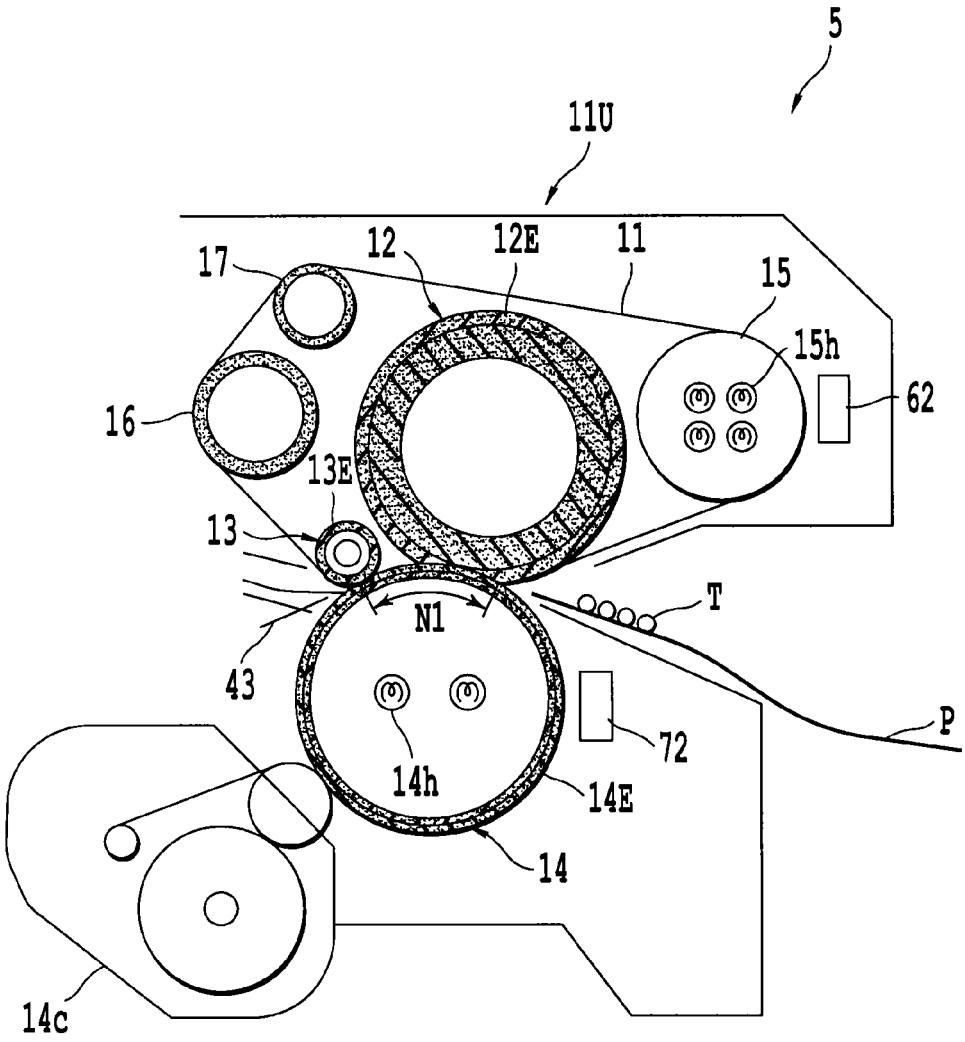
FIG. 2 is a sectional view of a fixing device included in the image forming apparatus shown in FIG. 1 seen from a front side of the image forming apparatus at which a user operates the image forming apparatus.

FIG. 2 is a sectional view of the fixing device 5 seen from a front side of the image forming apparatus 100 depicted in FIG. 1 at which a user operates the image forming apparatus 100.

As illustrated in FIG. 2, the fixing device 5 includes a fixing belt unit 11U, a pressing roller 14, a heater 14*h*, a web cleaning unit 14*c*, a separator 43, and temperature sensors 62 and 72. The fixing belt unit 11U includes a fixing belt 11, a fixing roller 12, a separation roller 13, a heating roller 15, a heater 15*h*, a tension roller 16, and a driven roller 17. The fixing roller 12 includes an elastic layer 12E. The separation roller 13 includes an elastic layer 13E. The pressing roller 14 includes an elastic layer 14E.

The fixing roller 12 has a cylindrical shape. The fixing belt 11 is stretched over the fixing roller 12, the separation roller 13, the heating roller 15, the tension roller 16, and the driven roller 17 with a predetermined tension. The pressing roller 14 is rotatably pressed against the fixing roller 12 via the fixing belt 11 to form a nip portion N1. The pressing roller 14 is also rotatably pressed against the separation roller 13 via the fixing belt 11 to form the nip portion N1. In other words, the nip portion N1 has a double-nip structure in which the pressing roller 14 is pressed against the fixing roller 12 and the separation roller 13 via the fixing belt 11 at two nip positions. The fixing belt 11, the fixing roller 12, the separation roller 13, the heating roller 15, the heater 15*h*, the tension roller 16, and the driven roller 17 are integrated into the fixing belt unit 11U. The separator 43 is provided downstream from the nip portion N1 in the sheet conveyance direction. Specifically, a front edge of the separator 43 is disposed close to the pressing roller 14 to prevent a sheet P serving as a recording medium from winding around the pressing roller 14.

The fixing belt 11 serves as an endless belt for fixing a toner image T on the sheet P. The fixing belt 11 may include three layers, which are a base layer, an elastic layer provided on the base layer, and a releasing layer provided on the elastic layer. The base layer may include nickel, stainless steel, and/or polyimide. The elastic layer may include silicon rubber.

For example, the fixing belt 11 has an inner diameter of about 115 mm, and includes the base layer including endless polyimide resin having a high heat resistance, a low thermal expansion, and a relatively great strength. The elastic layer including silicon rubber and having a thickness of about 200 μm is provided on the base layer. The releasing layer serves as an outermost layer having a tube shape covering the elastic layer, and includes fluorocarbon resin such as PFA (tetrafluoroethylene-perfluoroalkylvinylether copolymer) which is released from toner easily. Alternatively, the fixing belt 11 may be coated with fluorocarbon resin.

The fixing roller 12 includes a base roller having a hollow cylindrical shape, and the heat-resistant elastic layer 12E serving as a first elastic layer provided on an outer circumferential surface of the base roller. The heat-resistant elastic layer 12E includes silicon rubber (e.g., solid silicon rubber) or silicon sponge (e.g., silicon rubber foam). For example, the heat-resistant elastic layer 12E including silicon rubber foam having a thickness of about 14 mm is provided on the outer circumferential surface of the base roller so that the fixing roller 12 has an outer diameter of about 65 mm.

The separation roller 13 has an outer diameter smaller than the outer diameter of the fixing roller 12, and includes a core metal and the heat-resistant elastic layer 13E serving as a second elastic layer. A heat pipe is provided inside the core metal to reduce temperature fluctuation in an axial direction of the separation roller 13. The heat-resistant elastic layer 13E includes silicon rubber (e.g., solid silicon rubber) having a hardness lower than a hardness of the fixing roller 12 or silicon sponge (e.g., silicon rubber foam). For example, an aluminum roller having a thickness of about 1 mm is coated with silicon rubber or fluorocarbon resin so that the separation roller 13 has an outer diameter of about 16 mm. Alternatively, the separation roller 13 may be coated with fluorocarbon rubber or solid rubber. The separation roller 13 is rotational about a center axis of the fixing roller 12, and the pressing roller 14 is pressed against the separation roller 13 via the fixing belt 11.

The tension roller 16 applies a predetermined tension to the fixing belt 11 by using springs. For example, the springs provided in both ends of the tension roller 16 in an axial direction of the tension roller 16 apply a tension of about 9.8 N, respectively, so that the tension roller 16 applies a total tension of about 19.6 N to the fixing belt 11.

The heating roller 15 serves as a hollow roller including aluminum or iron. For example, the heating roller 15 may be a hollow cylindrical aluminum roller having an outer diameter of about 35 mm and a thickness of about 0.6 mm. The heater 15*h* (e.g., a halogen heater) serving as a heat source is provided inside the heating roller 15 to heat the fixing belt 11. Accordingly, a heat source is not provided inside a loop formed by the fixing belt 11 at a position which receives pressure applied by the pressing roller 14, that is, at the nip portion N1. Alternatively, an induction heater (IH) may serve as a heat source. The temperature sensor 62 detects temperature of a region of the fixing belt 11 contacted by the heating roller 15.

The pressing roller 14 serves as a cylindrical roller in which the heat-resistant elastic layer 14E serving as a third elastic layer including silicon rubber (e.g., solid silicon rubber) or silicon sponge (e.g., silicon rubber foam) is provided on a core metal including aluminum or iron. For example, silicon rubber having a thickness of about 1.5 mm covers an outer circumferential surface of the hollow steel core metal having a thickness of about 1 mm. An outermost layer having a tube shape and including PFA covers the elastic layer 14E, so that the pressing roller 14 has an outer diameter of about 65 mm.

The heater 14*h* is provided inside the pressing roller 14, and is turned on and off according to temperature of the pressing roller 14 detected by the temperature sensor 72. Accordingly, the pressing roller 14 does not draw heat from the sheet P when the sheet P passes through the nip portion N1.

The web cleaning unit 14*c* contacts an outer circumferential surface of the pressing roller 14 to remove offset toner and paper dust from the outer circumferential surface of the pressing roller 14.

Figure 3:
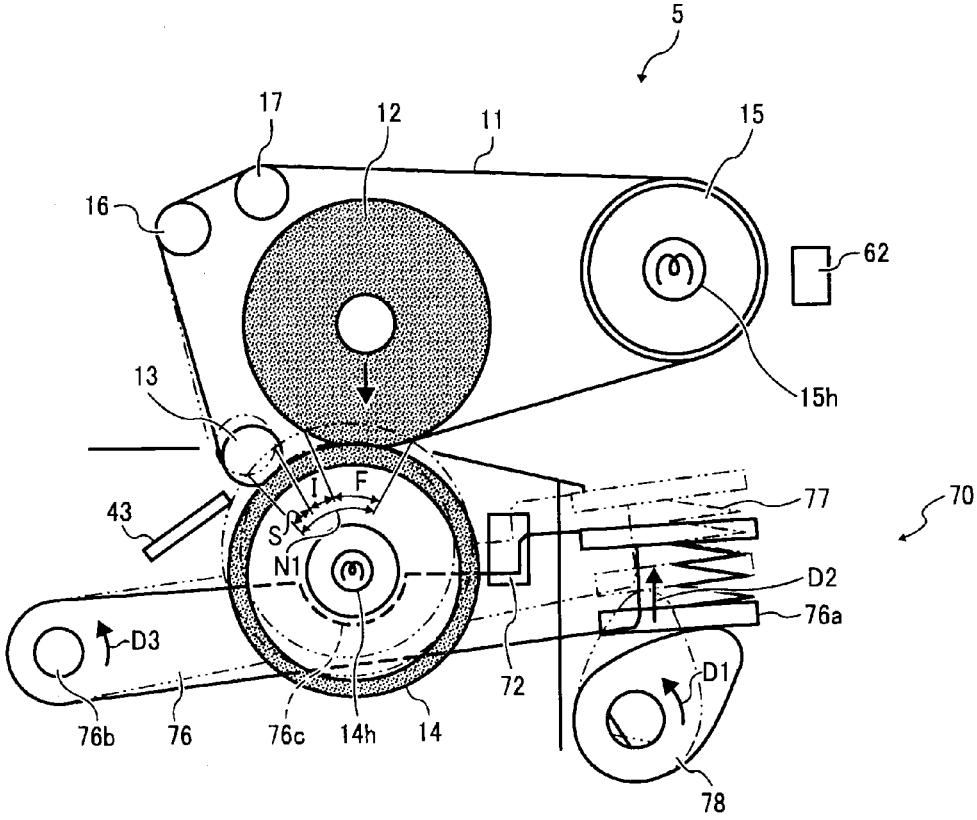
FIG. 3 is a sectional view of a pressure adjuster included in the fixing device shown in FIG. 2.

FIG. 3 is a sectional view of the fixing device 5. As illustrated in FIG. 3, the fixing device 5 further includes a pressure adjuster 70. The pressure adjuster 70 includes a pressing lever 76, a pressing member 76*a*, a support shaft 76*b*, a pressing portion 76*c*, a spring 77, and a cam 78.

The pressure adjuster 70 presses the pressing roller 14 against the fixing roller 12 and the separation roller 13 via the fixing belt 11 to form or release the nip portion N1. A nip length of the nip portion N1 is adjustable according to type of the sheet P and finishing of the toner image T (e.g., a gloss mode or a non-gloss mode). FIG. 3 illustrates a state in which rotation of the cam 78 illustrated in a chain double-dashed line applies great nip pressure at the nip portion N1 and a state in which rotation of the cam 78 illustrated in a solid line applies small nip pressure at the nip portion N1.

The following describes an operation of the pressure adjuster 70 to press the pressing roller 14 against the fixing roller 12. When an external driving force rotates the cam 78 counterclockwise in FIG. 3 in a rotation direction D1 by a predetermined rotation angle, the cam 78 pushes up the pressing member 76*a* in a direction D2. Accordingly, the spring 77 mounted on the pressing member 76*a* pushes up a swing end of the pressing lever 76 in a direction perpendicular to an axial direction of the pressing roller 14 with predetermined pressure. Consequently, the pressing lever 76 rotates about the support shaft 76*b* counterclockwise in FIG. 3 in a rotation direction D3. Thereafter, the pressing portion 76*c* provided between the swing end of the pressing lever 76 and the support shaft 76*b* contacts a shaft of the pressing roller 14 to push the pressing roller 14 toward the fixing roller 12. Finally, the pressing roller 14 is pressed against the fixing roller 12 and the separation roller 13 via the fixing belt 11. Accordingly, the pressing roller 14 is pressed against the fixing roller 12 at a first nip region F formed between the pressing roller 14 and the fixing roller 12 with constant pressure. Similarly, the pressing roller 14 is pressed against the separation roller 13 at a second nip region S formed between the pressing roller 14 and the separation roller 13 with constant pressure. Thus, the first nip region F, the second nip region S, and an intermediate nip region I provided between the first nip region F and the second nip region S form the nip portion N1 for fixing the toner image T on the sheet P. Alternatively, the spring 77 may be omitted. In this case, the cam 78 directly pushes up the swing end of the pressing lever 76.

The pressing roller 14 sinks into the fixing roller 12 via the fixing belt 11 by a predetermined depth, for example, in a range from about 3.0 mm to about 3.5 mm. The separation roller 13 is pressed against the pressing roller 14 by predetermined pressure, for example, about 9.8 N at each of both ends of the separation roller 13 in the axial direction of the separation roller 13. Accordingly, the nip portion N1 has a predetermined nip length of about 35 mm, for example. The great nip length of the nip portion N1 provides proper fixing for various types of paper, high-speed fixing, and improved productivity.

As illustrated in FIG. 2, when the fixing device 5 is driven, a driving motor provided for the fixing device 5 rotates the pressing roller 14 counterclockwise in FIG. 2. The fixing roller 12 and the separation roller 13 rotate clockwise in FIG. 2 to rotate the fixing belt 11 clockwise in FIG. 2 in a direction to convey the sheet P in a state in which the driven roller 17 and the tension roller 16 press against the fixing belt 11 and apply proper tension to the fixing belt 11. In order to fix the toner image T on the sheet P, heat generated by the heater 15*h* provided inside the heating roller 15 heats the fixing belt 11 up to a predetermined temperature (e.g., a proper fixing temperature) based on a temperature detected by the temperature sensor 62.

Thereafter, when the sheet P bearing the toner image T passes through the nip portion N1 from right to left in FIG. 2, pressure and heat are applied to the sheet P at the nip portion N1 to melt and fix the toner image T on the sheet P.

Specifically, as illustrated in FIG. 3, the toner image T is mostly fixed on the sheet P at an entrance region, that is, the first nip region F of the nip portion N1. Thus, the toner image T is melted sufficiently and therefore has a great viscosity. Accordingly, when the sheet P passes through the intermediate nip region I of the nip portion N1 in a state in which the sheet P is adhered to the fixing belt 11 due to the great viscosity of the toner image T, nip pressure not smaller than about 5 N/cm$^2$ is needed to convey the sheet P properly. The nip pressure is suppressed to about 15 N/cm$^2$ or smaller, that is, below a level required for gloss finishing. The sheet P is separated from the fixing belt 11 by a great curvature of the separation roller 13 having a small diameter, and is separated from the pressing roller 14 by the separator 43. Thus, the sheet P is discharged from the nip portion N1.

The nip portion N1 provides a total nip time not smaller than about 60 m/s with respect to a linear velocity of the sheet P. Nip pressure in a range from about 15 N/cm$^2$ to about 30 N/cm$^2$ is applied at about 50 percent or more of the total nip length of the nip portion N1 in the gloss mode. Thus, the fixing device 5 fixes a toner image on various types of paper including thick paper having a weight of about 300 g/m$^2$.

Pressure applied between the pressing roller 14 and the fixing roller 12 via the fixing belt 11 is adjusted to increase and decrease the nip length of the intermediate nip region I of the nip portion N1. When the sheet P has a weight not greater than a weight of plain paper, pressure applied between the pressing roller 14 and the fixing roller 12 is adjusted to increase the nip length of the intermediate nip region I of the nip portion N1 applied with nip pressure in a range from about 5 N/cm$^2$ to about 15 N/cm$^2$. Thus, when a thin sheet such as plain paper is used and therefore the thin sheet receives excessive heat, nip pressure is decreased to suppress gloss finishing. In other words, even when a thin sheet having a weight not greater than a weight of plain paper is used in the non-gloss mode and the thin sheet receives excessive heat, the nip length of the intermediate nip region I of the nip portion N1 is adjusted to apply a gloss equivalent to a gloss applied to a thick sheet. Further, in the gloss mode, the nip length of the intermediate nip region I of the nip portion N1 is adjusted by considering thickness of the sheet P to adjust nip pressure so as to provide a uniform gloss to finalized toner images formed on various types of sheets. Thus, the fixing device 5 provides improved reliability by applying a desired gloss in each of the gloss mode and the non-gloss mode.

For example, as nip pressure distribution at the nip portion N1, a load in a range from about 15 N/cm$^2$ to about 30 N/cm$^2$ is applied to the entrance region of the nip portion N1 in the sheet conveyance direction, that is, the first nip region F formed between the pressing roller 14 and the fixing roller 12. A load in a range from about 15 N/cm$^2$ to about 30 N/cm$^2$ is applied to an exit region of the nip portion N1 in the sheet conveyance direction, that is, the second nip region S formed between the pressing roller 14 and the separation roller 13. A load in a range from about 5 N/cm$^2$ to about 15 N/cm$^2$ is applied to the intermediate nip region I provided between the entrance region and the exit region in the sheet conveyance direction.

When gloss paper is used as the sheet P in the gloss mode, the pressure adjuster 70 adjusts the nip length of the first nip region F formed between the pressing roller 14 and the fixing roller 12 to about 20 mm, the nip length of the intermediate nip region I provided between first nip region F and the second nip region S to about 13 mm, and the nip length of the second nip region S formed between the pressing roller 14 and the separation roller 13 to about 2 mm. When plain paper is used as the sheet P in the non-gloss mode, the pressure adjuster 70 adjusts the nip length of the first nip region F to about 15 mm, the nip length of the intermediate nip region I to about 13 mm, and the nip length of the second nip region S to about 1 mm.

Figure 4:
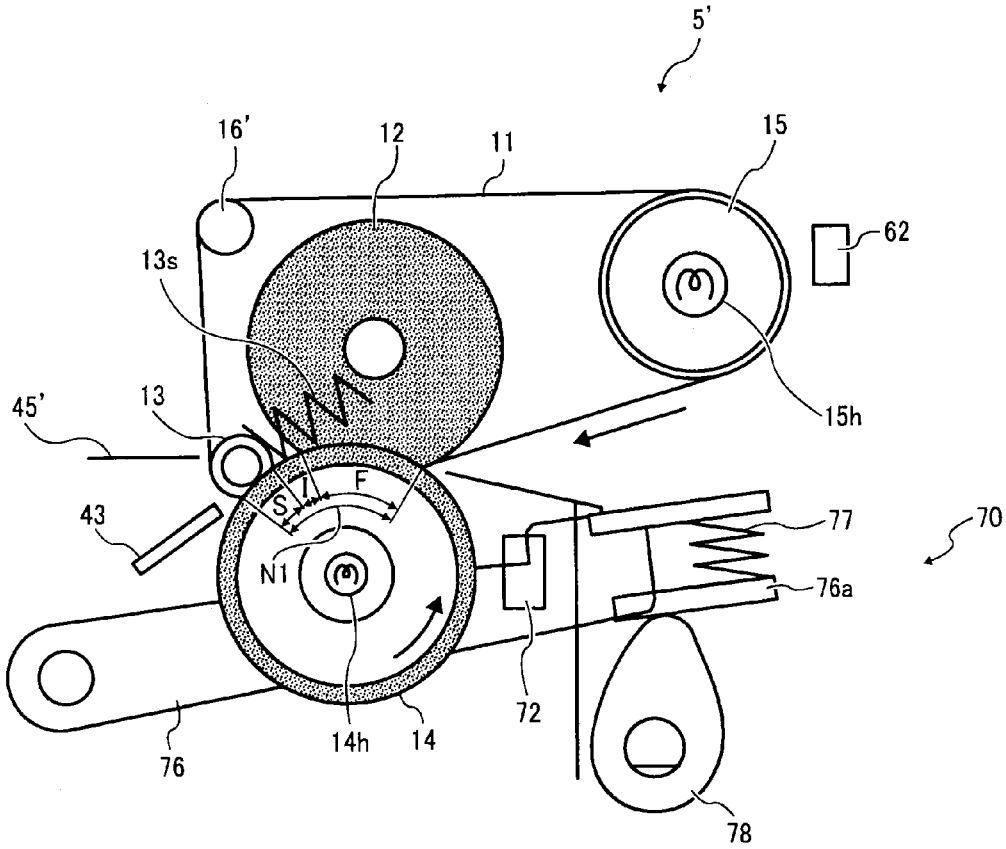
FIG. 4 is a sectional view of a fixing device according to another exemplary embodiment of the present invention.

FIG. 4 is a sectional view of a fixing device 5' equivalent to the fixing device 5 depicted in FIG. 3. As illustrated in FIG. 4, the fixing device 5' includes a spring 13*s*, a support roller 16', and a guide 45'. The support roller 16' replaces the tension roller 16 and the driven roller 17 depicted in FIG. 3. The other elements of the fixing device 5' are equivalent to the elements of the fixing device 5.

Figure 5:
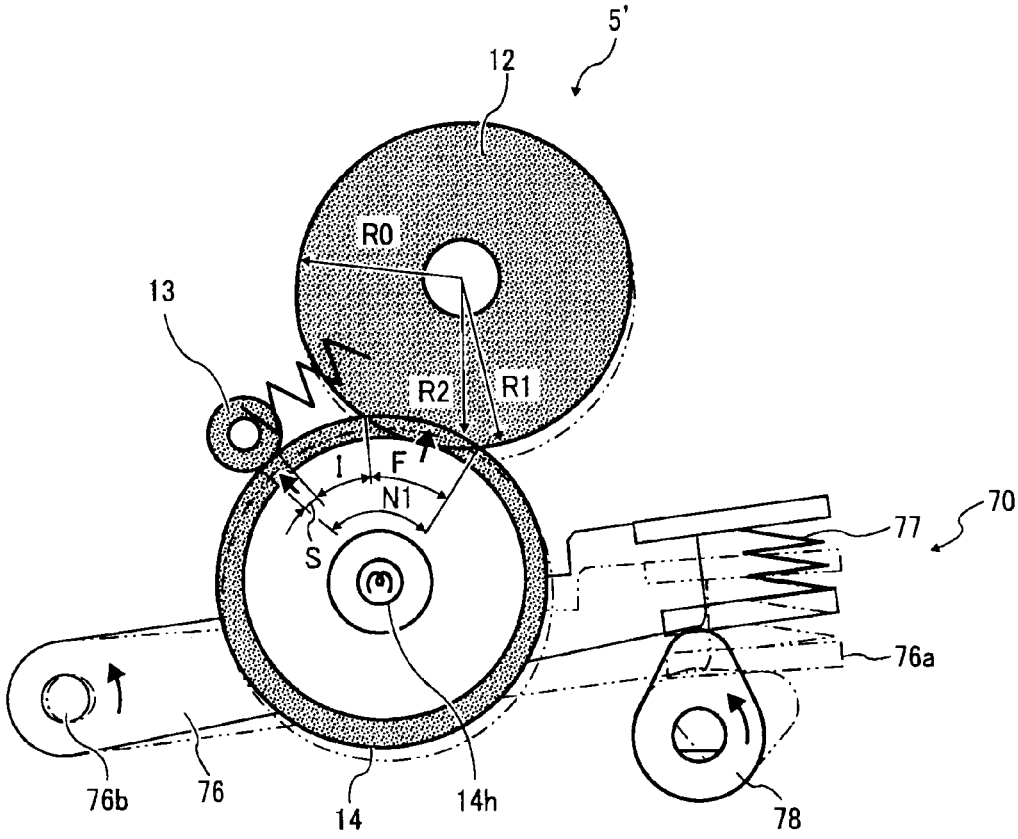
FIG. 5 is a sectional view of the fixing device shown in FIG. 4 for explaining movement of a pressure adjuster included in the fixing device and change in diameter of a fixing roller included in the fixing device.

FIG. 5 is a sectional view of the fixing device 5' for explaining movement of the pressure adjuster 70 and change in the diameter of the fixing roller 12.

Figure 6:
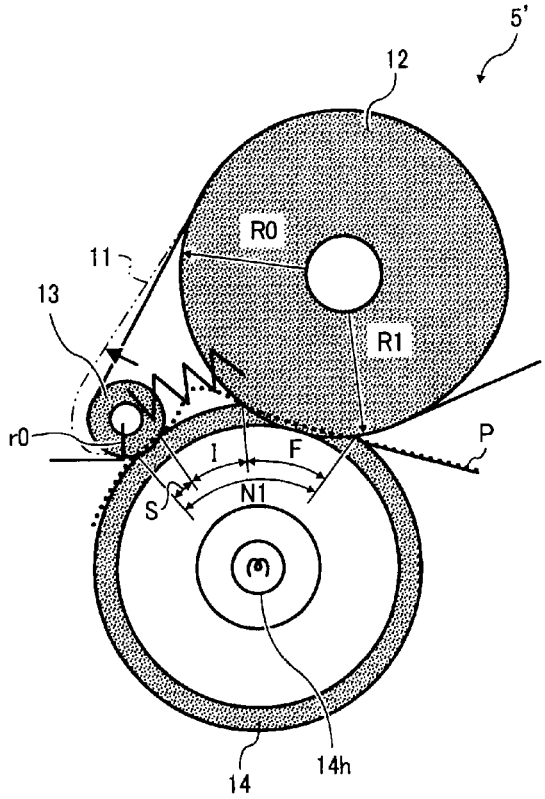
FIG. 6 is a sectional view of the fixing device shown in FIG. 5 for showing a fixing belt included in the fixing device contacting at two positions on the fixing roller shown in FIG. 5.

FIG. 6 is a sectional view of the fixing device 5' for showing the fixing belt 11 contacting the fixing roller 12 at two positions on the fixing roller 12.

Figure 7:
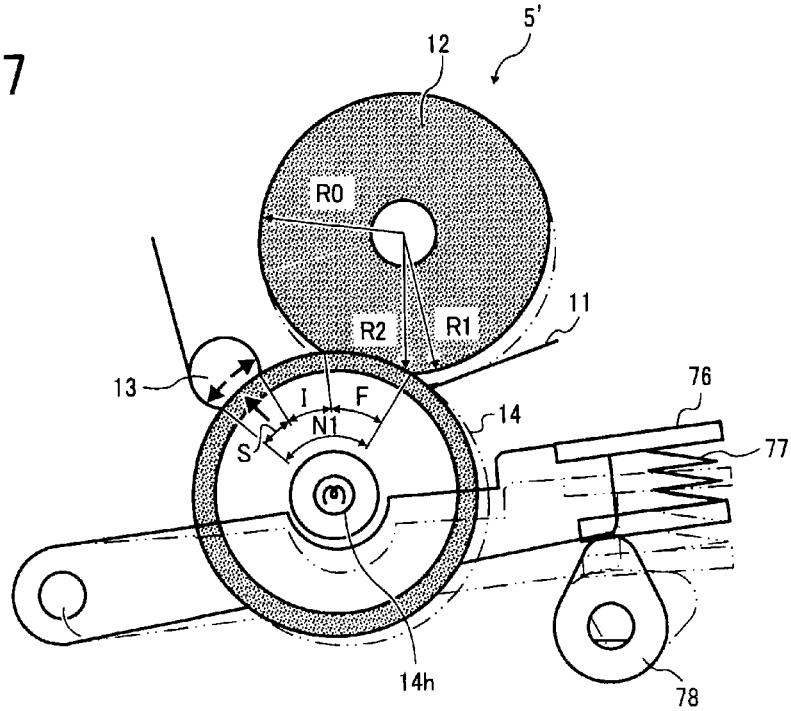
FIG. 7 is a sectional view of the fixing device shown in FIG. 6 for showing deformation of a fixing roller, a separation roller, and a pressing roller included in the fixing device, and the fixing belt shown in FIG. 6 wound around the fixing roller, the separation roller, and the pressing roller.

FIG. 7 is a sectional view of the fixing device 5' for showing deformation of the fixing roller 12, the separation roller 13, and the pressing roller 14, and the fixing belt 11 wound around the fixing roller 12, the separation roller 13, and the pressing roller 14.

Figure 8:
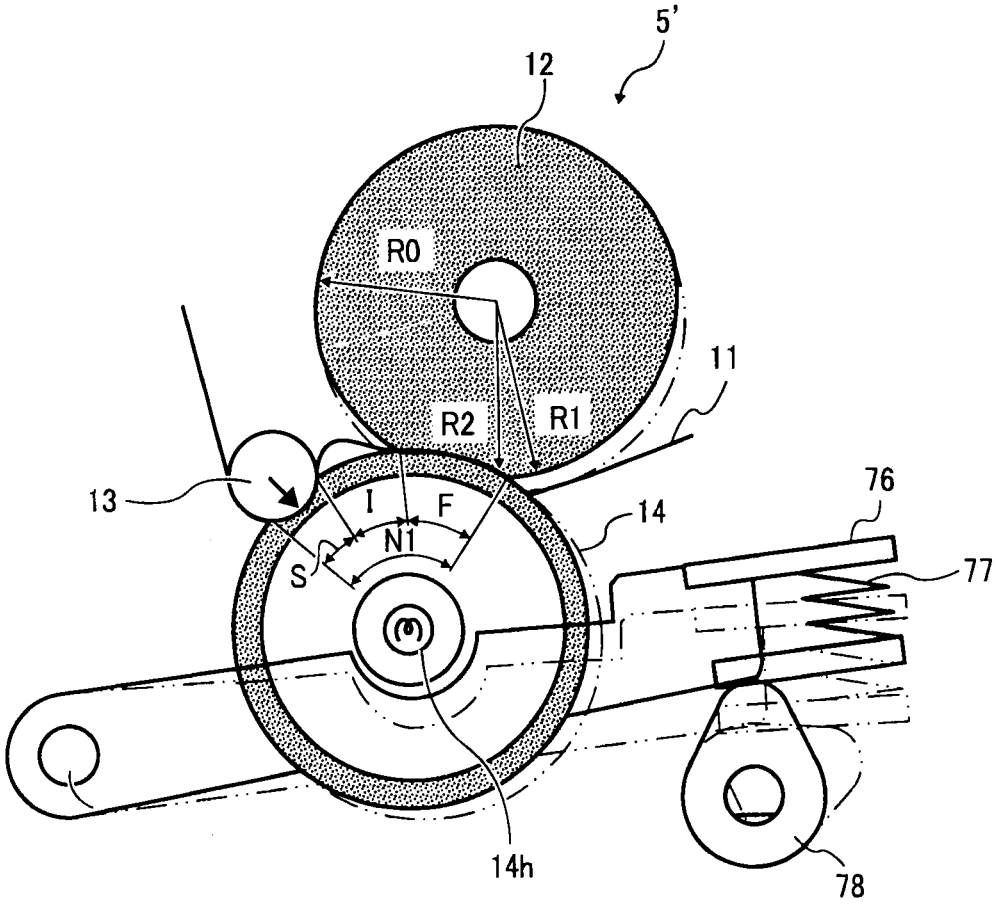
FIG. 8 is a sectional view of the fixing device shown in FIG. 6 for showing deformation of a fixing roller, a separation roller, and a pressing roller included in the fixing device, and the fixing belt shown in FIG. 6 wound around the fixing roller, the separation roller, and the pressing roller when the fixing roller, the separation roller, and the pressing roller do not have predetermined roller hardnesses, respectively.

FIG. 8 is a sectional view of the fixing device 5' for showing deformation of the fixing roller 12, the separation roller 13, and the pressing roller 14, and the fixing belt 11 wound around the fixing roller 12, the separation roller 13, and the pressing roller 14 when the fixing roller 12, the separation roller 13, and the pressing roller 14 do not have predetermined roller hardnesses, respectively.

When the fixing device 5' uses oilless toner, separation of a sheet P at an exit of the nip portion N1 depends on property of wax included in the toner and separation curvature with respect to the sheet conveyance direction at the exit of the nip portion N1. According to this exemplary embodiment, the fixing belt 11 contacting a toner image T on the sheet P and being wound around the fixing roller 12 and the separation roller 13 is wound around the pressing roller 14 by the fixing roller 12 and the separation roller 13. The sheet conveyance direction at the exit of the nip portion N1 corresponds to a tangent direction of the pressing roller 14, that is, a direction directed to a side opposite to the toner image T, and is extended obliquely downward in FIG. 6. Thus, the sheet P is separated from the fixing belt 11 easily.

As illustrated in FIG. 6, a radius r0 of the separation roller 13 wound by the fixing belt 11 is smaller than a radius R0 of the fixing roller 12 wound by the fixing belt 11, and therefore the separation roller 13 has a curvature greater than a curvature of the fixing roller 12. Accordingly, when the separation roller 13 is disposed at the exit of the nip portion N1, the sheet P is separated from the fixing belt 11 more easily than when the fixing roller 12 is disposed at the exit of the nip portion N1. Consequently, the sheet P separated from the separation roller 13 at the exit of the nip portion N1 is guided by the guide 45' (depicted in FIG. 4) provided above the exit of the nip portion N1 to a conveyance path. Thus, the sheet P is conveyed properly. When the sheet P bears a solid toner image T on a front side thereof and no toner image on a back side thereof in duplex printing, the sheet P is adhered to the pressing roller 14 easily. To address this, the separator 43 (depicted in FIG. 4) provided below the exit of the nip portion N1 separates the sheet P from the pressing roller 14 and guides the sheet P to the conveyance path.

In the fixing device 5' according to this exemplary embodiment, the fixing roller 12, the separation roller 13, and the pressing roller 14 have roller hardnesses A, B, and C, respectively, which have a relation shown by a formula (1) below.

$$C \geqq A > B \quad (1)$$

The roller hardness may be measured by a known method and may represent hardness of each roller as Japanese Industrial Standards JIS-A or C hardness.

When the fixing belt 11 is separated from the pressing roller 14 at the intermediate nip region I provided between the fixing roller 12 and the separation roller 13 as illustrated in FIG. 6, the toner image T may be shifted from a proper position on the sheet P or heat applied to the sheet P may fluctuate. Specifically, shifting of the toner image T may occur when a moving velocity of the fixing belt 11 facing the toner image T differs from a circumferential velocity of the pressing roller 14 for feeding the sheet P in a state in which the fixing belt 11 is separated from the pressing roller 14 at the intermediate nip region I. Fluctuation of heat applied to the sheet P may occur when the sheet P is partially separated from the fixing belt 11 at the intermediate nip portion I at which the fixing belt 11 is separated from the pressing roller 14.

To address this, according to this exemplary embodiment, the fixing roller 12, the separation roller 13, and the pressing roller 14 have the roller hardnesses A, B, and C defined by the above formula (1). Accordingly, the fixing roller 12, the separation roller 13, and the pressing roller 14 are deformed and wound by the fixing belt 11 properly as illustrated in FIG. 7. Specifically, the roller hardness A of the fixing roller 12 is smaller than the roller hardness C of the pressing roller 14, and therefore pressure applied by the pressing roller 14 dents the fixing roller 12 to have a concave shape. Thus, the fixing roller 12 presses the fixing belt 11 against the pressing roller 14.

The separation roller 13 has the small diameter to provide an improved separation curvature at the exit of the nip portion N1. However, the roller hardness B of the separation roller 13 is smaller than the roller hardness A of the fixing roller 12, and is even smaller than the roller hardness C of the pressing roller 14, as shown in the above formula (1). Accordingly, regardless of the small diameter, the separation roller 13 is deformed at the nip portion N1 easily. Specifically, the pressing roller 14 presses against and dents the separation roller 13 to have a concave shape. Thus, the separation roller 13 presses the fixing belt 11 against the pressing roller 14. Accordingly, the fixing belt 11 is pressed against the pressing roller 14 strongly at upstream and downstream positions from the intermediate nip region I in the sheet conveyance direction. Moreover, the fixing belt 11 has a predetermined level of rigidity, and is stretched by tension. Accordingly, the fixing belt 11 is pressed against the pressing roller 14 without being separated from the pressing roller 14 even at the intermediate nip region I. Consequently, shifting of the toner image T on the sheet P and fluctuation of heat applied to the sheet P are suppressed.

By contrast, when the roller hardness B of the separation roller 13 does not satisfy the relation shown by the formula (1), that is, when the roller hardness B of the separation roller 13 is not smaller than the roller hardness A of the fixing roller 12, the separation roller 13 dents the pressing roller 14 to have a concave shape at the second nip region S at which the separation roller 13 is pressed against the pressing roller 14, as illustrated in FIG. 8. Accordingly, the fixing belt 11 is wound around the separation roller 13. Further, at an entrance to the second nip region S, which is provided upstream from the separation roller 13 in the sheet conveyance direction, a force for attracting the fixing belt 11 having rigidity toward the separation roller 13 is applied to the fixing belt 11. As a result, the fixing belt 11 may not be wound around the pressing roller 14 easily, and therefore may be separated from the pressing roller 14 at the intermediate nip region I. To address this, the roller hardness B of the separation roller 13 needs to be smaller than the roller hardness A of the fixing roller 12.

The separation roller 13 may be a tension roller for applying tension to the fixing belt 11 at the intermediate nip region I provided between the fixing roller 12 and the separation roller 13 in the sheet conveyance direction. For example, as illustrated in FIG. 4, a mechanism including the spring 13*s* may cause the separation roller 13 to apply a predetermined tension to the fixing belt 11. One end of the spring 13*s* is attached to the separation roller 13, and another end of the spring 13*s* is attached to the fixing roller 12. A tension of about 9.8 N may be applied to each of both ends of the separation roller 13 in the axial direction of the separation roller 13. Thus, a total tension of about 19.6 N is applied to the separation roller 13. Accordingly, in addition to effects provided by the roller hardnesses A, B, and C defined by the above formula (1), the fixing belt 11 is wound around the pressing roller 14 stably by the tension applied by the separation roller 13.

Twisting of the fixing belt 11 due to the fixing roller 12 including an elastic body may occur due to difference between nip pressure at one end in an axial direction of the fixing belt 11 and nip pressure at another end in the axial direction of the fixing belt 11 at the nip portion N1. In a structure in which the fixing belt 11 contacts the fixing roller 12 again at a contact position downstream from the nip portion N1 in the sheet conveyance direction like the fixing belt 11 illustrated in a chain double-dashed line in FIG. 6, movement of the fixing belt 11 may differ between both ends in the axial direction of the fixing belt 11 at the contact position, and therefore the fixing belt 11 may be twisted. Specifically, when the fixing roller 12 including the elastic body is deformed at the nip portion N1, a radius R1 of the fixing roller 12 at positions immediately upstream and downstream from the nip portion N1 in the sheet conveyance direction is greater than the radius R0 of the fixing roller 12 which is not deformed. Accordingly, the fixing belt 11 for conveying the sheet P moves fast at the first nip region F of the nip portion N1. The fixing roller 12 serving as a driving roller receives a rotation force at a position at which the fixing roller 12 has the radius R1. Accordingly, the fixing roller 12 rotates slowly at a position at which the fixing roller 12 has the radius R0. Therefore, when the fixing belt 11 contacts the fixing roller 12 again at the contact position downstream from the nip portion N1 in the sheet conveyance direction as illustrated in the chain double-dashed line in FIG. 6, the fixing belt 11 may be twisted. To address this, according to this exemplary embodiment, the fixing belt 11 is supported by the support roller 16' and the heating roller 15 at positions downstream from the nip portion N1 in the sheet conveyance direction as illustrated in FIG. 4. Thus, the fixing belt 11 does not contact the fixing roller 12 at a position other than the nip portion N1, and therefore is not twisted.

As illustrated in FIG. 2, in order to cause the fixing roller 12, the separation roller 13, and the pressing roller 14 to have the roller hardnesses A, B, and C satisfying the above formula (1), respectively, the elastic layer 14E of the pressing roller 14 may include a material equivalent to an elastic material of the elastic layer 12E of the fixing roller 12, but may have a thickness smaller than a thickness of the elastic layer 12E of the fixing roller 12. The elastic layer 13E of the separation roller 13 may include a material having a hardness smaller than a hardness of the elastic material of the elastic layer 12E of the fixing roller 12. For example, the fixing roller 12 and the pressing roller 14 include an identical elastic material such as silicon rubber or silicon sponge, but the elastic layer 14E of the pressing roller 14 is thinner than the elastic layer 12E of the fixing roller 12. Accordingly, the fixing roller 12 is deformed easily to have a concave shape by pressure applied by the pressing roller 14, and presses the fixing belt 11 against the pressing roller 14.

The separation roller 13 is coated with an elastic material (e.g., low-hardness silicon rubber or low-hardness silicon sponge) softer than the elastic material of the fixing roller 12. Accordingly, even with the small diameter, the separation roller 13 is deformed more easily to have a concave shape by pressure applied by the pressing roller 14 than the fixing roller 12. Further, tension applied by the spring 13*s* (depicted in FIG. 4) winds the fixing belt 11 around the pressing roller 14 stably, suppressing separation of the fixing belt 11 from the pressing roller 14 at the intermediate nip region I stably.

When the pressure adjuster 70 depicted in FIG. 4 moves the pressing roller 14 to adjust the nip length of the first nip region F formed between the pressing roller 14 and the fixing roller 12, the fixing device 5' may include a biasing member (e.g., the spring 13*s* depicted in FIG. 4) for moving the separation roller 13 in accordance with movement of the pressing roller 14 caused by the pressure adjuster 70.

As described above, the pressure adjuster 70 moves the pressing roller 14 in such a manner that the pressing roller 14 applies pressure to the fixing belt 11 stably, so as to adjust the nip length of the nip portion N1 formed between the pressing roller 14 and the fixing roller 12 via the fixing belt 11 or release the nip portion N1. Change in the nip length of the first nip region F of the nip portion N1 formed between the pressing roller 14 and the fixing roller 12 causes a relation of the radiuses R0, R1, and R2 of the fixing roller 12 to satisfy a following formula (2) as illustrated in FIG. 5.

$$R1>R2>R0 \quad (2)$$

As illustrated in FIG. 8, the velocity of the fixing belt 11 at the nip portion N1 changes to cause the velocity of the moving fixing belt 11 to be close to a circumferential velocity of the fixing roller 12 at the first nip region F of the nip portion N1. However, the nip length of the first nip region F decreases, and pressure applied by the fixing roller 12 to press the fixing belt 11 against the pressing roller 14 decreases. Accordingly, the fixing belt 11 is separated from the pressing roller 14 easily at the intermediate nip region I, resulting in shifting of a toner image T on a sheet P and fluctuation of heat applied to the sheet P. To address this, according to this exemplary embodiment, the separation roller 13 moves in accordance with movement of the pressing roller 14. Therefore, even when the nip length of the first nip region F of the nip portion N1 formed between the pressing roller 14 and the fixing roller 12 changes, the nip length of the second nip region S of the nip portion N1 formed between the pressing roller 14 and the separation roller 13 does not change, or changes in an amount smaller than an amount of change of the nip length of the first nip region F of the nip portion N1. Accordingly, the separation roller 13 presses the fixing belt 11 against the pressing roller 14 with great pressure to stretch the fixing belt 11 constantly, suppressing shifting of the toner image T on the sheet P and fluctuation of heat applied to the sheet P.

The separation roller 13 having the diameter smaller than the diameter of the fixing roller 12 and moving in accordance with movement of the pressing roller 14 separates the sheet P from the fixing belt 11 at the exit of the nip portion N1. In other words, the sheet P is separated from the fixing belt 11 easily at a constant position.

In the fixing device 5' according to this exemplary embodiment, the pressing roller 14 serves as a primary driving roller driven and rotated by a driving system such as a motor. An outer circumferential velocity of the primary driving roller is equivalent to a conveyance velocity for conveying a sheet P. The pressing roller 14, which has the elastic layer 14E thinner than the elastic layer 12E of the fixing roller 12 and has surface temperature with little fluctuation, may be used as the primary driving roller.

Figure 9A:
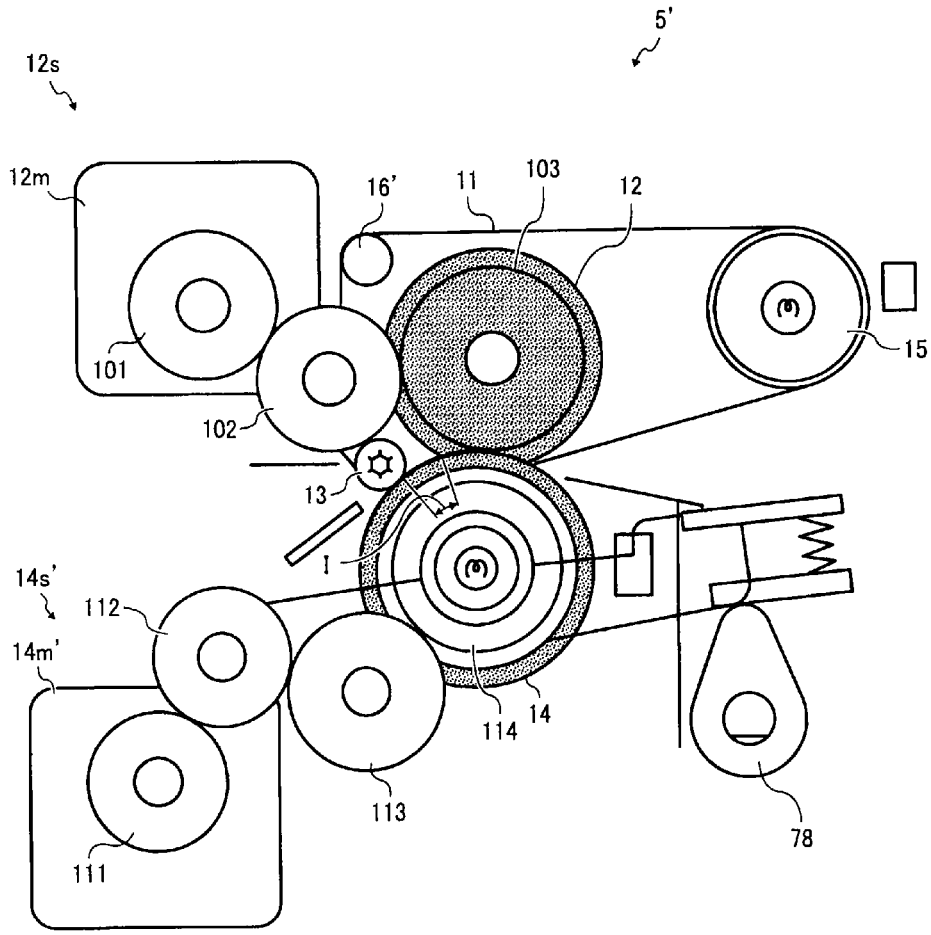
FIG. 9A is a sectional view of the fixing device shown in FIG. 4 for explaining driving systems included in the fixing device.

FIG. 9A is a sectional view of the fixing device 5'. As illustrated in FIG. 9A, the fixing device 5' further includes a first driving system 12*s* and a second driving system 14*s*'. The first driving system 12*s* includes a first motor 12*m* and gears 101, 102, and 103. The second driving system 14*s*' includes a second motor 14*m*' and gears 111, 112, 113, and 114.

Figure 9B:
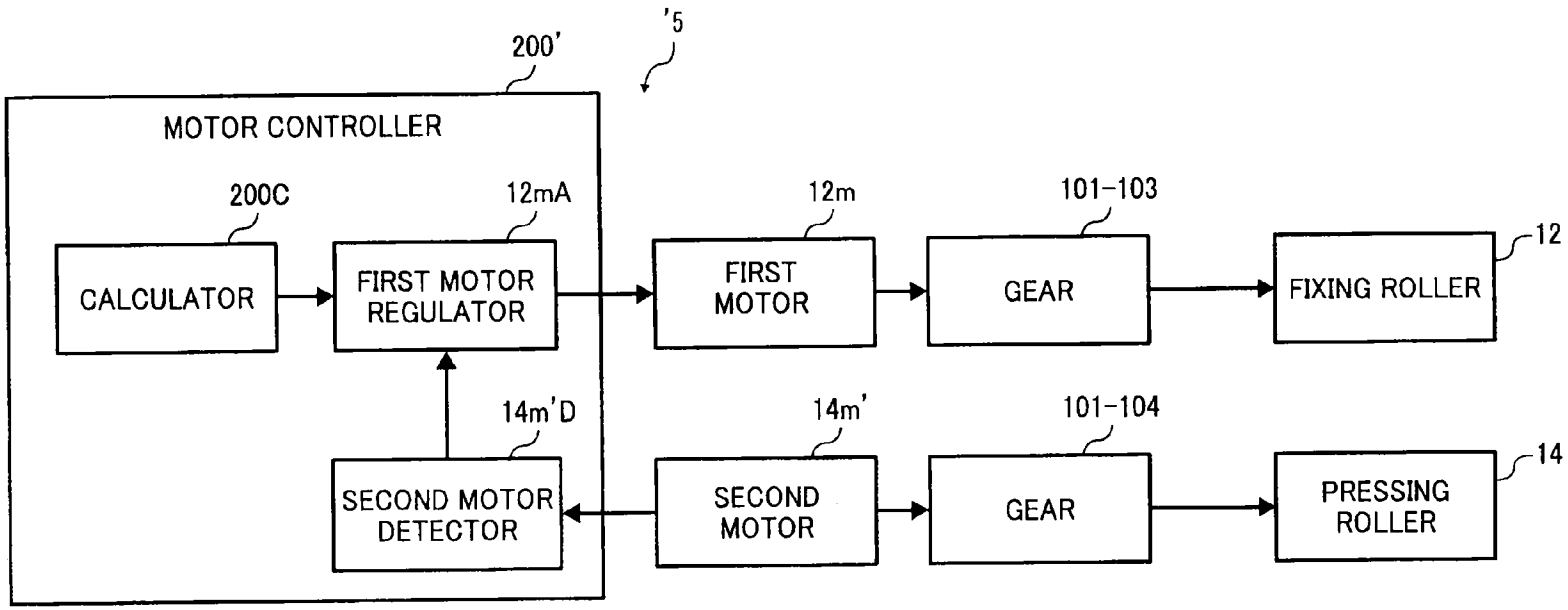
FIG. 9B is a block diagram of the fixing device shown in FIG. 9A.

FIG. 9B is a block diagram of the fixing device 5'. As illustrated in FIG. 9B, the fixing device 5' further includes a motor controller 200'. The motor controller 200' includes a first motor regulator 12*m*A, a second motor detector 14*m*'D, and a calculator 200C.

The first motor 12*m* for driving the fixing roller 12 is provided separately from the second motor 14*m*' for driving the pressing roller 14. The motor controller 200' includes a CPU (central processing unit), a ROM (read-only memory), and a RAM (random-access memory), for example, and controls the first motor 12*m* and/or the second motor 14*m*' so that the moving velocity of the fixing belt 11 is not greater than the circumferential velocity of a surface of the pressing roller 14.

The first motor 12*m* generates a driving force to be transmitted to the fixing roller 12 via the gears 101 to 103 to rotate the fixing roller 12. The rotating fixing roller 12 rotates the fixing belt 11. The fixing belt 11 rotated by the rotating fixing roller 12 rotates the heating roller 15, the separation roller 13, and the support roller 16' having a cylindrical shape. The second motor 14*m*' generates a driving force to be transmitted to the pressing roller 14 via the gears 111 to 114 to rotate the pressing roller 14.

A driver of the fixing device 5' is divided into the first motor 12*m* for driving the fixing roller 12 and the second motor 14*m*' for driving the pressing roller 14, so as to adjust a difference between the velocity of the fixing belt 11 and the velocity of the pressing roller 14 at the intermediate nip region I generated due to a temperature difference between the fixing roller 12 and the pressing roller 14 and variation in thickness of a sheet P. Accordingly, the fixing belt 11 and the pressing roller 14 move at an identical velocity at the intermediate nip region I constantly. Consequently, tension applied by the separation roller 13 to the fixing belt 11 prevents the fixing belt 11 from separating from the pressing roller 14 at the intermediate nip region I stably, preventing shifting of a toner image T on the sheet P and fluctuation of heat applied to the sheet P with improved stability.

The motor controller 200' adjusts a number of rotations (e.g., the RPM) of the first motor 12*m* based on torque change of the second motor 14*m*'. For example, the first motor regulator 12*m*A adjusts the number of rotations of the first motor 12*m* based on a torque of the second motor 14*m*' detected by the second motor detector 14*m*'D.

As described above, shifting of the toner image T on the sheet P and fluctuation of heat applied to the sheet P may occur when the fixing belt 11 and the pressing roller 14 move at different velocities, respectively, as the fixing belt 11 is separated from the pressing roller 14 at the intermediate nip region I. In this case, unlike when the fixing belt 11 and the pressing roller 14 move at the identical velocity, the fixing belt 11 and the pressing roller 14 partially scratch each other with a great force, increasing torque of the first motor 12*m* and the second motor 14*m*'. By contrast, under a lowest torque, the fixing belt 11 and the pressing roller 14 move at the identical velocity, and therefore the fixing belt 11 is not separated from the pressing roller 14. To address this, according to this exemplary embodiment, since driving of the pressing roller 14 determines the conveyance velocity for conveying the sheet P, a number of rotations (e.g., the RPM) of the pressing roller 14 is maintained at a predetermined value to detect change in torque of the second motor 14*m*'. Based on the change in torque of the second motor 14*m*' detected by the second motor detector 14*m*'D, the first motor regulator 12*m*A changes the number of rotations of the first motor 12*m* for driving the fixing roller 12 which rotates the fixing belt 11 to prevent shifting of the toner image T on the sheet P and fluctuation of heat applied to the sheet P.

Figure 10:
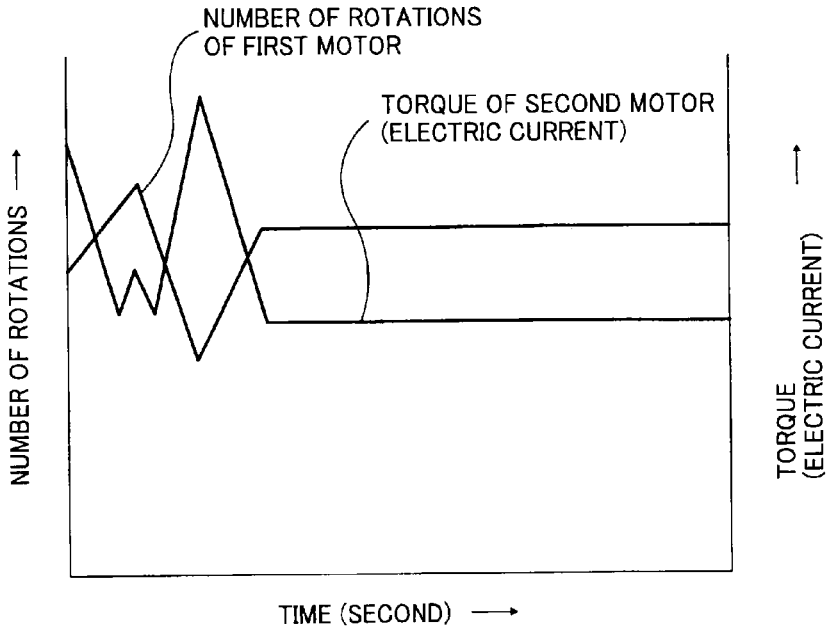
FIG. 10 is a graph illustrating control of a number of rotations of a first motor performed by a motor controller included in the fixing device shown in FIG. 9B.

FIG. 10 is a graph illustrating one example of control of the number of rotations of the first motor 12*m* performed by the motor controller 200' depicted in FIG. 9B.

For example, when the number of rotations of the second motor 14*m*' is changed to a predetermined value, torque (e.g., electric current) of the second motor 14*m*' increases. To address this, the motor controller 200' increases the number of rotations of the first motor 12*m*. Thereafter, the motor controller 200' adjusts (e.g., increases and decreases) the number of rotations of the first motor 12*m* for several times based on a detection result of torque of the second motor 14*m*'. When the second motor 14*m*' has a lowest level of torque, the number of rotations of the first motor 12*m* is stabilized.

As the total nip length of the nip portion N1 and pressure distribution at the nip portion N1 change depending on a pressing state in which the pressing roller 14 is pressed against the fixing roller 12, a pressing state in which the fixing belt 11 is pressed against the pressing roller 14 changes at the intermediate nip region I. To address this, the calculator 200C of the motor controller 200' calculates and stores in advance the number of rotations of the first motor 12*m* to cause the lowest torque level of the second motor 14*m*' for various pressing conditions under which the pressing roller 14 is pressed against the fixing roller 12. Since the number of rotations of the second motor 14*m*' is constant, the calculator 200C of the motor controller 200' also calculates and stores a ratio between the number of rotations of the first motor 12*m* and the number of rotations of the second motor 14*m*'. Accordingly, when the fixing device 5' is turned on, the first motor regulator 12*m*A of the motor controller 200' selects a proper ratio between the number of rotations of the first motor 12*m* and the number of rotations of the second motor 14*m*' from the ratios stored in the calculator 200C, which corresponds to a pressing state in which the pressing roller 14 is pressed against the fixing roller 12. Thereafter, the motor controller 200' starts driving the first motor 12*m* and the second motor 14*m*' according to the selected ratio. Thus, operation time for adjusting the number of rotations of the first motor 12*m* is shortened to a short time period equivalent to a time period required in a normal state, that is, a normal pressing state in which the pressing roller 14 is pressed against the fixing roller 12, so as to adjust the number of rotations of the pressing roller 14 and the fixing roller 12 to an optimum velocity. Consequently, a sheet P is conveyed at the optimum velocity when the pressing roller 14 and the fixing roller 12 start feeding the sheet P, improving reliability of moving the sheet P.

Figure 11:
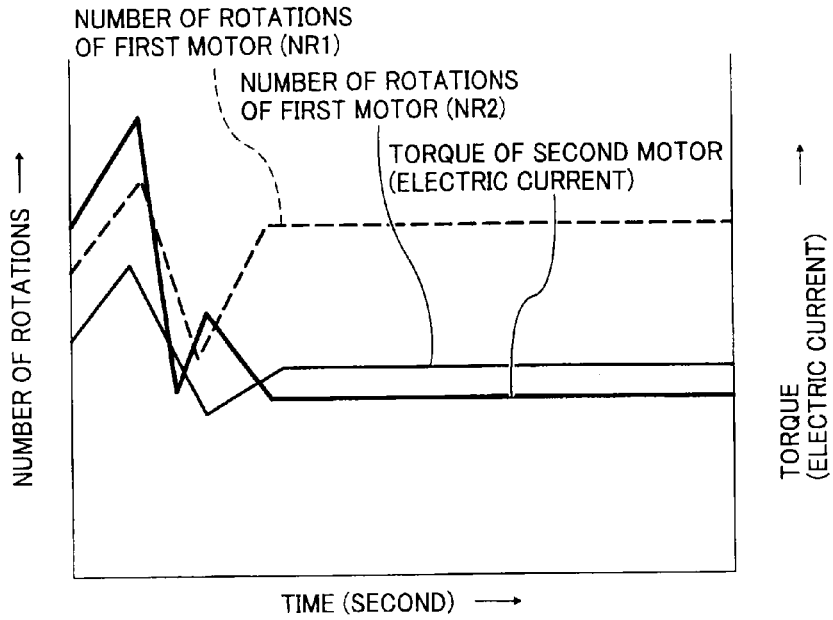
FIG. 11 is a graph illustrating another control of a number of rotations of a first motor performed by a motor controller included in the fixing device shown in FIG. 9B.

FIG. 11 is a graph illustrating another example of control of the number of rotations of the first motor 12*m* (depicted in FIG. 9A) performed by the motor controller 200' (depicted in FIG. 9B). In FIG. 11, "NR1" represents the number of rotations of the first motor 12*m* in the normal state. "NR2" represents the number of rotations of the first motor 12*m* under a different pressing condition according to this exemplary embodiment.

As illustrated in FIGS. 9A and 9B, when the stopped fixing device 5' resumes driving, the motor controller 200' determines the ratio between the number of rotations of the first motor 12*m* and the number of rotations of the second motor 14*m'* depicted in FIG. 9A corresponding to a pressing condition of the pressing roller 14 pressed against the fixing roller 12 and a conveyance condition under which the pressing roller 14 and the fixing roller 12 convey a sheet P based on the pressing condition, and starts driving the first motor 12*m* at the number of rotations NR2 of the first motor 12*m* calculated based on the determined ratio. Thereafter, the motor controller 200' increases and decreases the number of rotations of the first motor 12*m* for several times based on a detected torque of the second motor 14*m'* detected by the second motor detector 14*m'*D. When the second motor 14*m'* has a lowest torque, the number of rotations of the first motor 12*m* is stabilized, and the first motor 12*m* is driven. A time period required for the number of rotations of the first motor 12*m* to be stabilized after driving of the first motor 12*m* is started is equivalent to a time period required for the number of rotations NR1 of the first motor 12*m* to be stabilized after driving of the first motor 12*m* is started under a normal condition.

When a thick sheet P passes between the pressing roller 14 and the fixing roller 12, the pressing roller 14 moves in a direction to separate from the fixing roller 12 for an amount corresponding a thickness of the thick sheet P. When a sheet P having a lower surface friction coefficient passes between the pressing roller 14 and the fixing roller 12, the sheet P slips slightly at the nip portion N1. To address this, the motor controller 200' needs to increase the conveyance velocity for conveying the sheet P. Accordingly, the calculator 200C of the motor controller 200' calculates and stores in advance the number of rotations of the first motor 12*m* when the second motor 14*m'* has the lowest torque per thickness or type of a sheet P to be used. Since the number of rotations of the second motor 14*m'* is constant, the calculator 200C calculates and stores the ratio between the number of rotations of the first motor 12*m* and the number of rotations of the second motor 14*m'*. Accordingly, when the motor controller 200' starts driving the fixing device 5', the first motor regulator 12*m*A of the motor controller 200' selects a proper ratio between the number of rotations of the first motor 12*m* and the number of rotations of the second motor 14*m'*, which corresponds to thickness or type of the sheet P, from the ratios stored in the calculator 200C. Thereafter, the controller 200 starts driving the first motor 12*m* and the second motor 14*m'* based on the selected number of rotations of the first motor 12*m* and the second motor 14*m'*. Consequently, the number of rotations of the first motor 12*m* is adjusted in a shortened time period. In other words, the conveyance velocity for conveying the sheet P is adjusted to the optimum linear velocity in the shortened time period equivalent to a time period required in the normal state in which a normal sheet P is used. Thus, the fixing device 5' conveys the sheet P at the optimum linear velocity when the fixing device 5' starts feeding the sheet P, improving reliability of moving the sheet P.

The thickness or type of the sheet P may be selected by a user on a control panel provided in the image forming apparatus 100 depicted in FIG. 1, and is sent to the motor controller 200'.

Figure 12:
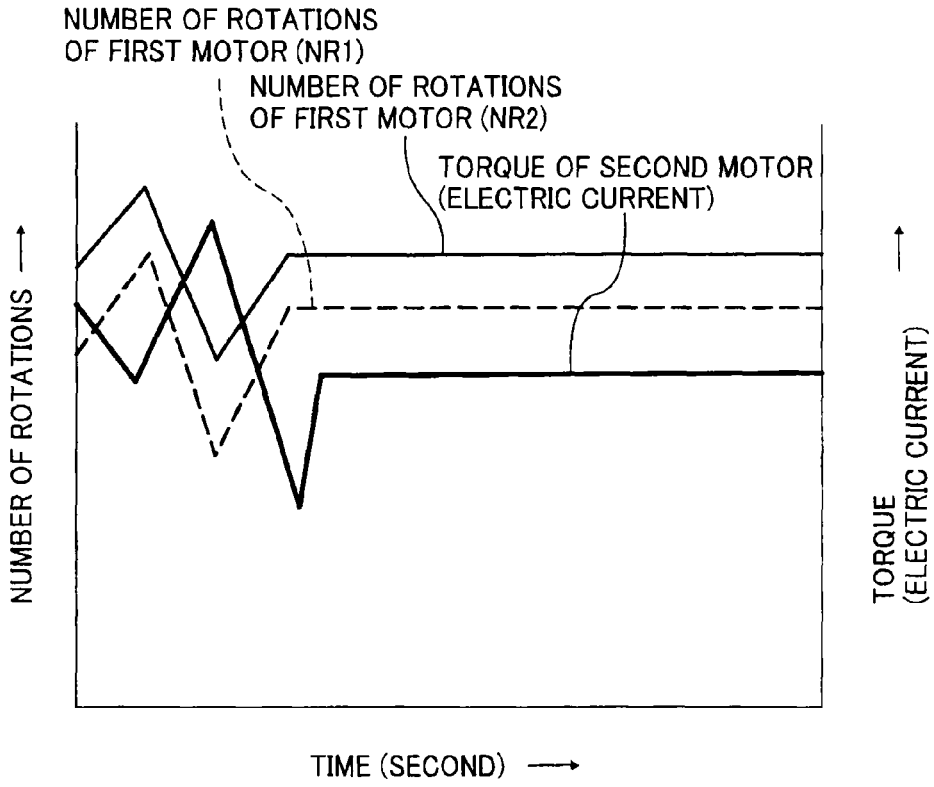
FIG. 12 is a graph illustrating yet another control of a number of rotations of a first motor performed by a motor controller included in the fixing device shown in FIG. 9B.

FIG. 12 is a graph illustrating yet another example of control of the number of rotations of the first motor 12*m* (depicted in FIG. 9A) performed by the motor controller 200' (depicted in FIG. 9B). In FIG. 12, "NR1" represents the number of rotations of the first motor 12*m* in the normal state. "NR2" represents the number of rotations of the first motor 12*m* when a thick sheet P or a coated sheet P having a low surface friction coefficient is used.

As illustrated in FIGS. 9A and 9B, when the stopped fixing device 5' resumes driving, the motor controller 200' determines the ratio between the number of rotations (e.g., the RPM) of the first motor 12*m* and the number of rotations (e.g., the RPM) of the second motor 14*m'* corresponding to a sheet condition such as thickness or type of a sheet P to be used and a conveyance condition under which the pressing roller 14 and the fixing roller 12 convey the sheet P based on the pressing condition of the pressing roller 14 pressed against the fixing roller 12, and starts driving the first motor 12*m* at the number of rotations NR2 of the first motor 12*m* calculated based on the determined ratio. Thereafter, the motor controller 200' increases and decreases the number of rotations of the first motor 12*m* for several times based on a detected torque of the second motor 14*m'* detected by the second motor detector 14*m'*D. When the second motor 14*m'* has a lowest torque, the number of rotations of the first motor 12*m* is stabilized, and the first motor 12*m* is driven. A time period required for the number of rotations of the first motor 12*m* to be stabilized after driving of the first motor 12*m* is started is equivalent to a time period required for the number of rotations NR1 of the first motor 12*m* to be stabilized after driving of the first motor 12*m* is started under the normal condition.

The first motor regulator 12*m*A of the motor controller 200' increases and decreases the number of rotations of the first motor 12*m* by a predetermined number of rotations with respect to a reference number of rotations X, and judges which of the increased number of rotations or the decreased number rotations of the first motor 12*m* provides a smaller torque value Y of the second motor 14*m'* which is detected by the second motor detector 14*m'*D of the motor controller 200'. Thereafter, the first motor regulator 12*m*A of the motor controller 200' changes the reference number of rotations X to a number of rotations (e.g., the RPM) of the first motor 12*m* corresponding to the smaller torque value Y by a predetermined number of rotations repeatedly until the detected torque value Y becomes smallest, so as to adjust the number of rotations of the first motor 12*m* The above-described control is performed constantly while the first motor 12*m* and the second motor 14*m'* rotate.

Figure 13:
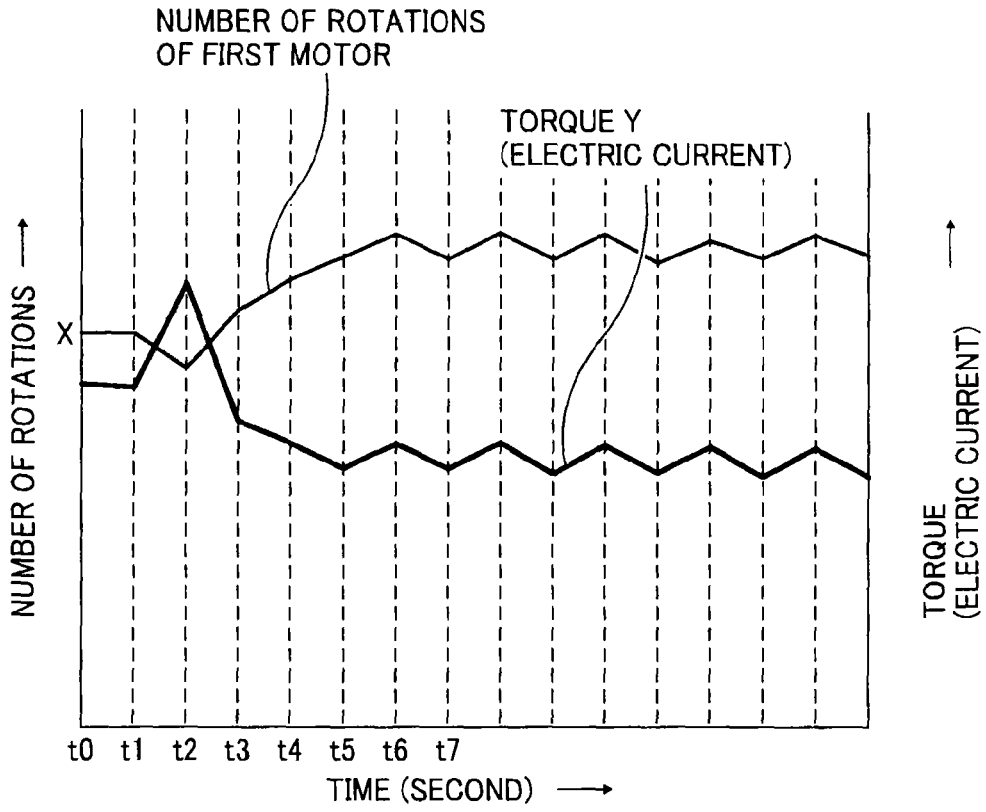
FIG. 13 is a graph illustrating yet another control of a number of rotations of a first motor performed by a motor controller included in the fixing device shown in FIG. 9B.

FIG. 13 is a graph illustrating yet another example of control of the number of rotations of the first motor 12*m* performed by the motor controller 200' depicted in FIG. 9B.

As illustrated in FIGS. 9A and 9B, the first motor regulator 12*m*A of the motor controller 200' increases and decreases the number of rotations of the first motor 12*m* slightly from a reference number of rotations X, and judges which of the increased number of rotations and the decreased number of rotations of the first motor 12*m* provides a smaller torque value Y of the second motor 14*m'* detected by the second motor detector 14*m'*D of the motor controller 200'. The first motor regulator 12*m*A changes the reference number of rotations X of the first motor 12*m* to the number of rotations corresponding to the smaller torque value Y of the second motor 14*m'* so as to change the number of rotations of the first motor 12*m* to a number of rotations (e.g., the RPM) corresponding to a smallest torque Y. According to this exemplary embodiment, the motor controller 200' performs the above-described control constantly while the motor controller 200' drives the first motor 12*m* and the second motor 14*m'*. Accordingly, an optimum number of rotations of the first motor 12*m* is obtained to correspond to change in conditions such as change in temperature of the pressing roller 14 and the fixing roller 12 when a sheet P passes between the pressing roller 14 and the fixing roller 12 and job interruption to use sheets P of various thicknesses or types, improving reliability of moving the sheet P.

Figure 14A:
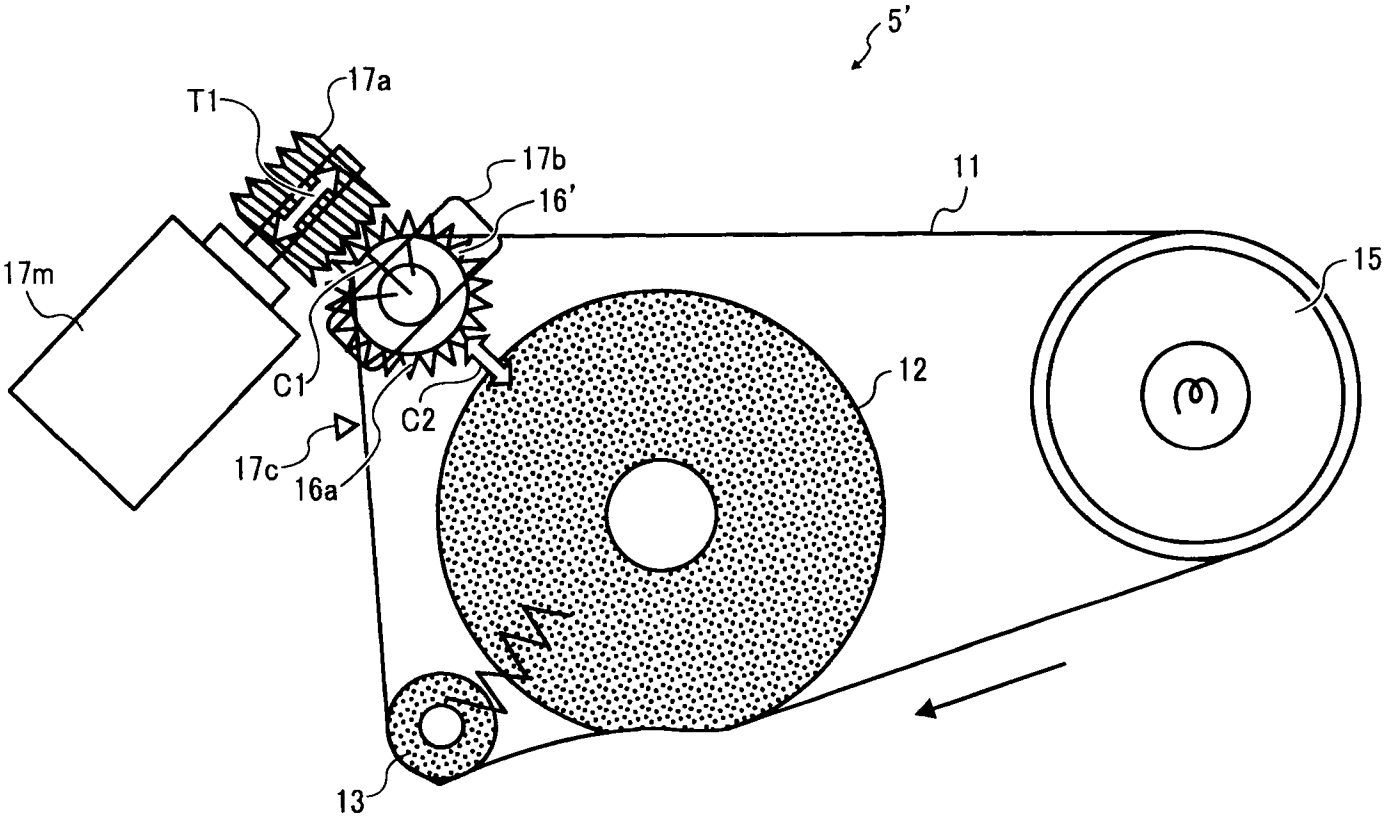
FIG. 14A is a sectional view of the fixing device shown in FIG. 4 for explaining correction of twisting of a fixing belt included in the fixing device.
Figure 14B:
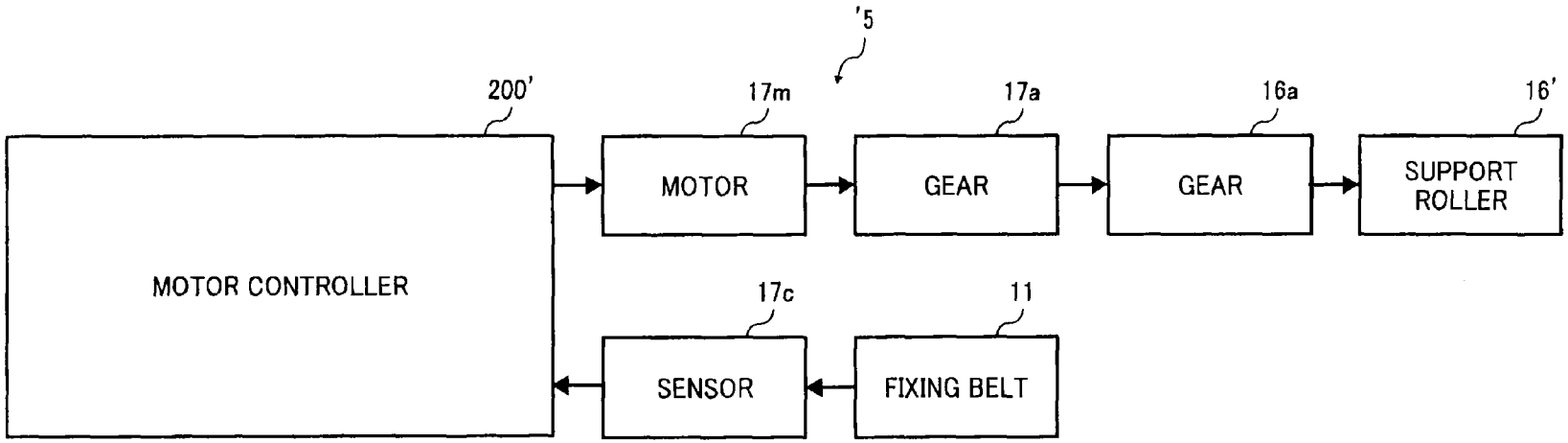
FIG. 14B is a block diagram of the fixing device shown in FIG. 14A.

FIG. 14A is a sectional view of the fixing device 5'. As illustrated in FIG. 14A, the fixing device 5' further includes gears 16*a* and 17*a*, a slit 17*b*, a sensor 17*c*, and a motor 17*m*. FIG. 14B is a block diagram of the fixing device 5'.

In order to prevent the fixing belt 11 from twisting in a width direction of the fixing belt 11 perpendicular to the sheet conveyance direction at a position downstream from the separation roller 13 in the sheet conveyance direction, a position of one end of the support roller 16' in a width direction, that is, in an axial direction of the support roller 16', is changed within a predetermined range in a direction T1 perpendicular to a connection line C1 connecting a midpoint on a wound portion of the fixing belt 11 wound around the support roller 16' to a roller center of the support roller 16'. The connection line C1 is parallel to a direction C2 in which the support roller 16' applies tension to the fixing belt 11. Specifically, a driving force generated by the motor 17*m* serving as a support roller motor is transmitted to the support roller 16' via the gear 17*a* mounted on a driving shaft of the motor 17*m* and the gear 16*a* mounted on one end of the support roller 16' in the axial direction of the support roller 16'. When the sensor 17*c* detects that the fixing belt 11 is twisted, the motor 17*m* moves one end of the support roller 16' in the axial direction of the support roller 16' along the slit 17*b* serving as a guide in a predetermined direction.

The following describes control operations for correcting twisting of the fixing belt 11 with the above-described structure. The sensor 17*c* serving as a fixing belt detector is provided at a position near the support roller 16'. For example, the sensor 17*c* may include two sensors provided near both ends of the fixing belt 11 in the width direction of the fixing belt 11, respectively. FIG. 14A illustrates the sensor 17*c* provided at a position upstream from the support roller 16' in a rotation direction of the fixing belt 11 rotating clockwise in FIG. 14A. Alternatively, the sensor 17*c* may be provided at a position downstream from the support roller 16' in the rotation direction of the fixing belt 11.

The sensor 17*c* detects a position of the fixing belt 11 in the width direction of the fixing belt 11. The motor controller 200' identifies the position of the fixing belt 11 based on a detection result provided by the sensor 17*c*, and determines a direction in which the support roller 16' moves. The motor controller 200' rotates the motor 17*m* according to the determined direction to move one end of the support roller 16' in the axial direction of the support roller 16' in the determined direction along the slit 17*b*. Namely, the motor controller 200' drives the motor 17*m* to tilt the support roller 16'. The motor controller 200' stops the motor 17*m* at a position at which detection by the sensor 17*c* is switched. Thus, even when the fixing belt 11 is twisted in the width direction of the fixing belt 11, the fixing device 5' corrects twisting of the fixing belt 11, maintaining stability of moving the fixing belt 11 and improving reliability of correcting twisting of the fixing belt 11.

Figure 15A:
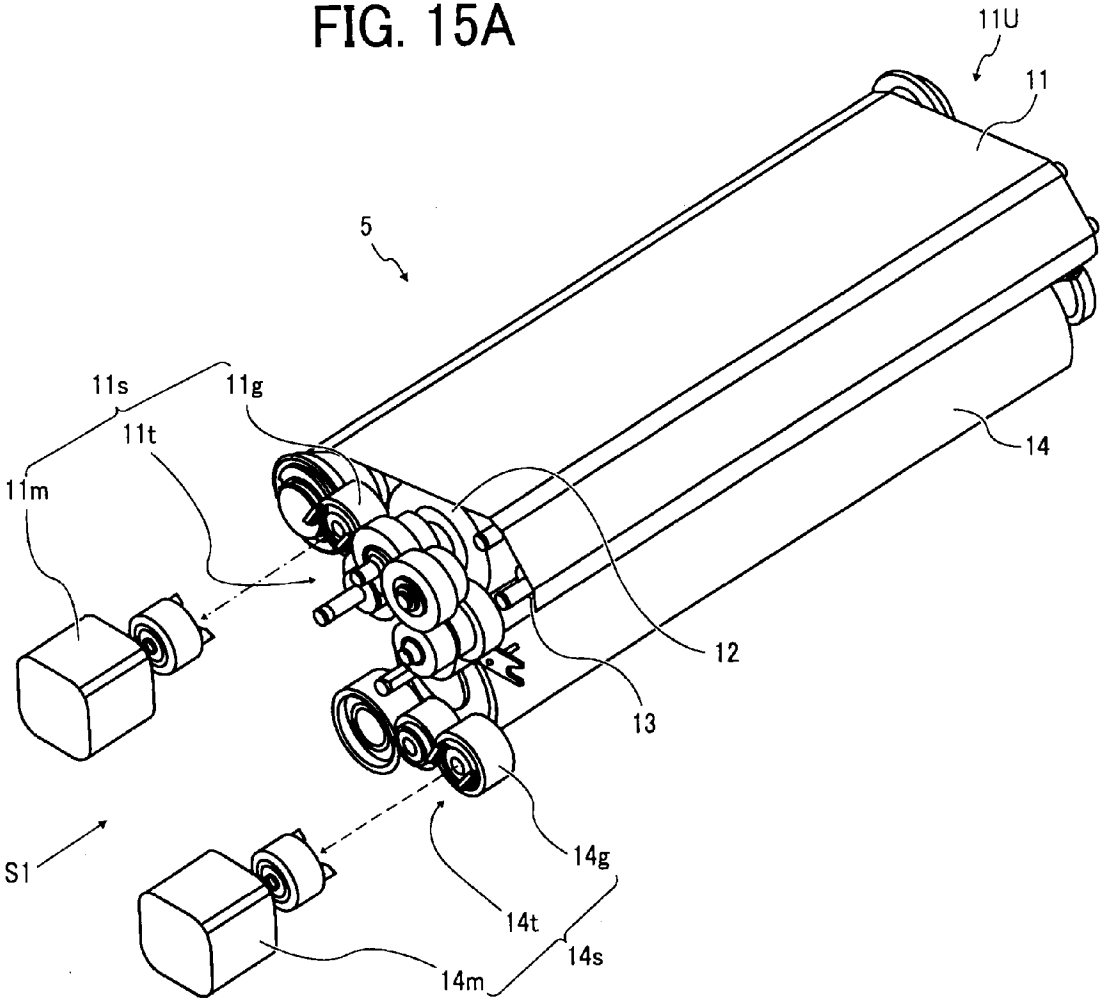
FIG. 15A is a perspective view of the fixing device shown in FIG. 2.
Figure 15B:
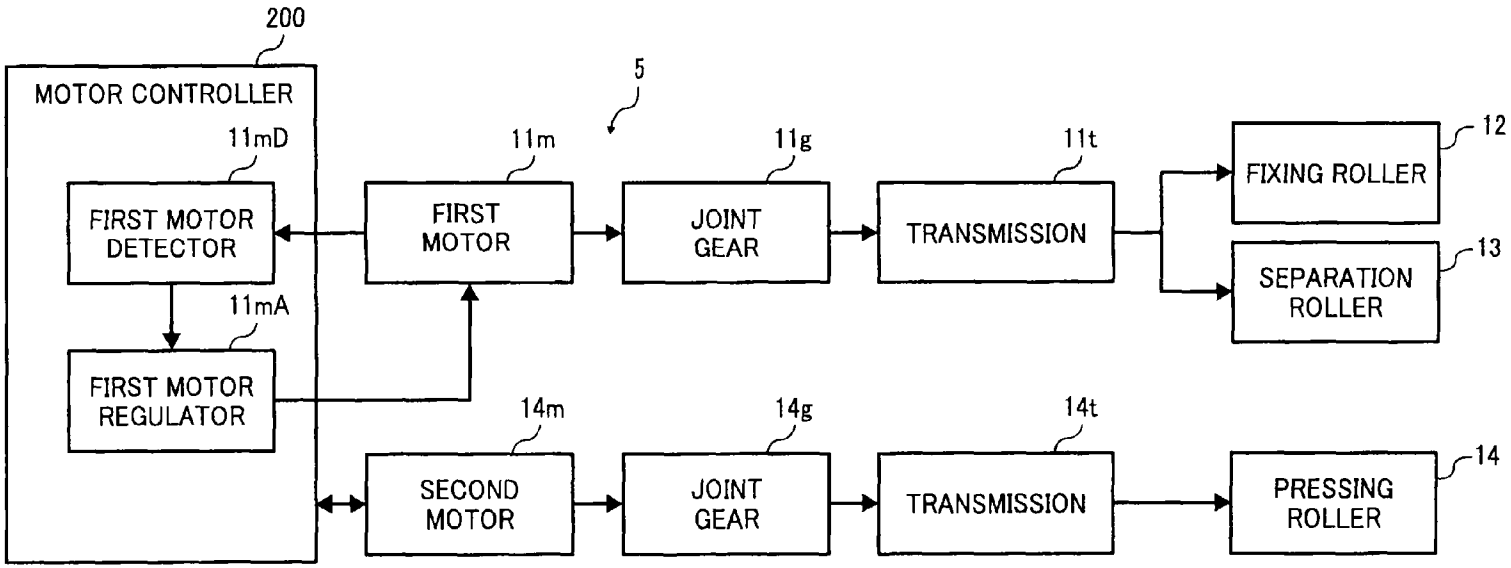
FIG. 15B is a block diagram of the fixing device shown in FIG. 15A.

Referring to FIGS. 15A and 15B, the following describes control operations for controlling rotation of the pressing roller 14 and the fixing roller 12 of the fixing device 5. FIG. 15A is a perspective view of the fixing device 5. As illustrated in FIG. 15A, the fixing device 5 further includes a first driving system 11*s* and a second driving system 14*s*. The first driving system 11*s* includes a first motor 11*m*, a joint gear 11*g*, and a first transmission 11*t*. The second driving system 14*s* includes a second motor 14*m*, a joint gear 14*g*, and a second transmission 14*t*.

FIG. 15B is a block diagram of the fixing device 5. As illustrated in FIG. 15B, the fixing device 5 further includes a motor controller 200. The motor controller 200 includes a first motor regulator 11*m*A and a first motor detector 11*m*D.

The fixing device 5 includes driving systems independently provided for the pressing roller 14 and the fixing belt unit 11U including the fixing belt 11, the fixing roller 12, the separation roller 13, the heating roller 15 (depicted in FIG. 3), the tension roller 16 (depicted in FIG. 3), and the driven roller 17 (depicted in FIG. 3), respectively.

The fixing device 5 includes the first driving system 11*s* including the first motor 11*m*, a one-way clutch, the joint gear 11*g*, and the first transmission 11*t* including a plurality of transmission gears, which correspond to the fixing belt unit 11U. The first driving system 11*s* transmits a driving force generated by the first motor 11*m* to the fixing roller 12 via the one-way clutch, and transmits the driving force generated by the first motor 11*m* to the separation roller 13. The fixing device 5 further includes the second driving system 14*s* including the second motor 14*m*, the joint gear 14*g*, and the second transmission 14*t* including a plurality of transmission gears, which correspond to the pressing roller 14. The second driving system 14*s* transmits a driving force generated by the second motor 14*m* to the pressing roller 14.

The first motor 11*m* and the second motor 14*m* may be provided in the image forming apparatus 100 depicted in FIG. 1. When the fixing device 5 is attached to the image forming apparatus 100, the first motor 11*m* is connected to the joint gear 11*g* serving as a driving force input portion of the fixing belt unit 11U. Similarly, the second motor 14*m* is connected to the joint gear 14*g* serving as a driving force input portion of the pressing roller 14.

With the above-described structure, the first transmission 11*t* transmits a driving force generated by the first motor 11*m* to the fixing belt unit 11U via the joint gear 11*g*. The second transmission 14*t* transmits a driving force generated by the second motor 14*m* to the pressing roller 14 via the joint gear 14*g*. The first driving system 11*s* and the second driving system 14*s* independently control driving of the fixing belt unit 11U and the pressing roller 14, respectively.

Figure 16A:
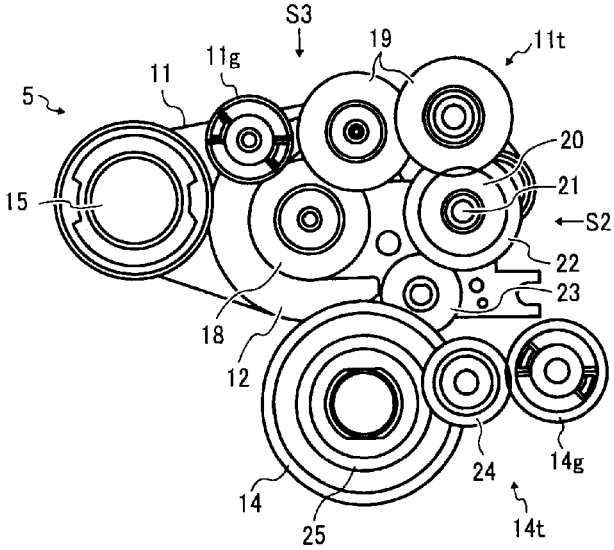
FIG. 16A is a front view of the fixing device shown in FIG. 15A seen from a direction S1 in FIG. 15A.

FIGS. 16A, 16B, 16C, 16D, and 16E illustrate a transmission channel for transmitting a driving force with the transmissions 11*t* and 14*t* of the fixing device 5. FIG. 16A is a front view of the fixing device 5 seen from a direction S1 in FIG. 15A.

As illustrated in FIG. 16A, the first transmission 11*t* includes a fixing gear 18, a double-gear 19, a shaft driving gear 20, a driving transmission shaft 21, a one-way gear 22, and a separation roller gear 23. The second transmission 14*t* includes a pressing idler gear 24 and a pressing gear 25.

Figure 16B:
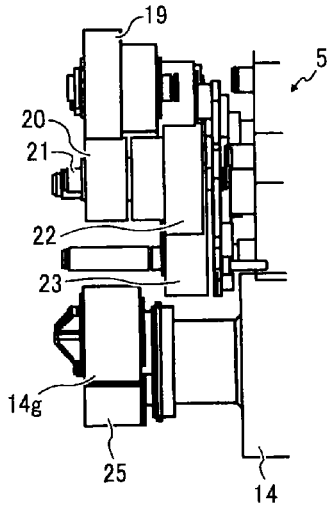
FIG. 16B is a partial side view of the fixing device shown in FIG. 16A seen from a direction S2 in FIG. 16A.
Figure 16C:
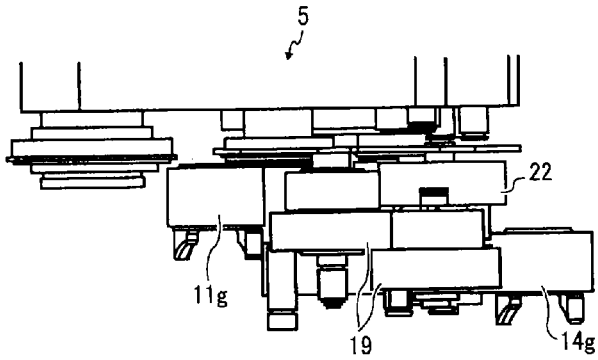
FIG. 16C is a partial top view of the fixing device shown in FIG. 16A seen from a direction S3 in FIG. 16A.
Figure 16D:
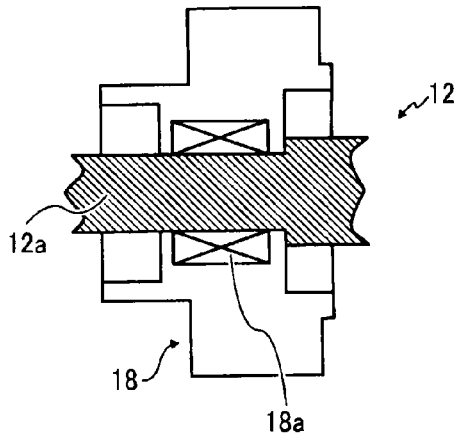
FIG. 16D is a sectional view of a fixing roller and a fixing gear included in the fixing device shown in FIG. 16A.

FIG. 16B is a partial side view of the fixing device 5 seen from a direction S2 in FIG. 16A. FIG. 16C is a partial top view of the fixing device 5 seen from a direction S3 in FIG. 16A. FIG. 16D is a sectional view of the fixing roller 12 and the fixing gear 18. As illustrated in FIG. 16D, the fixing roller 12 includes a flange 12*a*. The fixing gear 18 includes a one-way clutch 18*a*.

Figure 16E:
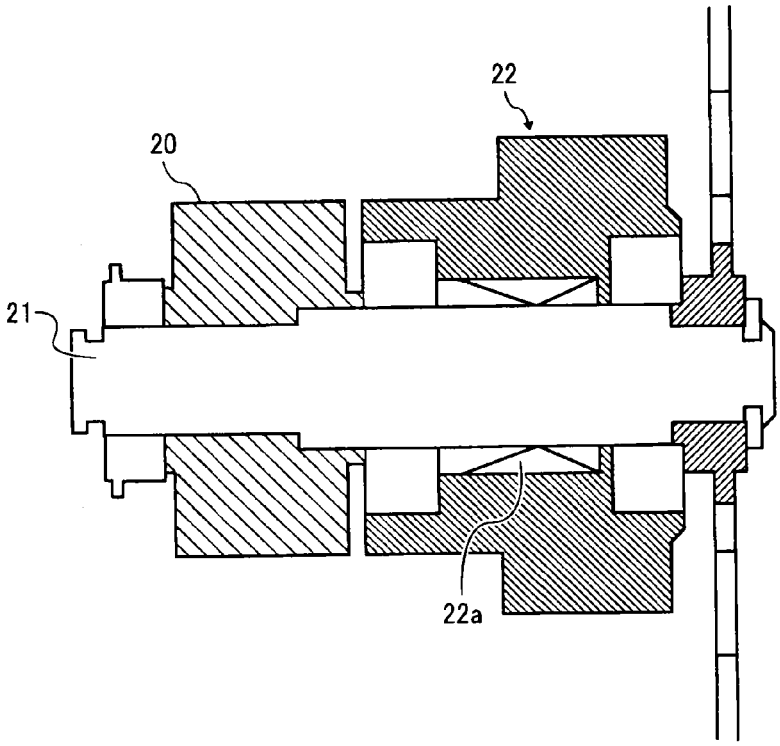
FIG. 16E is a sectional view of a shaft driving gear, a driving transmission shaft, and a one-way gear included in the fixing device shown in FIG. 16A.

FIG. 16E is a sectional view of the shaft driving gear 20 and the one-way gear 22. As illustrated in FIG. 16E, the one-way gear 22 includes a one-way clutch 22*a*.

In FIGS. 16A, 16B, 16C, 16D, and 16E, the first motor 11*m* and the second motor 14*m* are omitted.

As illustrated in FIG. 16A, the first transmission 11*t* includes the joint gear 11*g*, the fixing gear 18, the double-gear 19, the shaft driving gear 20, the driving transmission shaft 21, the one-way gear 22, and the separation roller gear 23. The joint gear 11*g* is connected to the first motor 11*m* depicted in FIG. 15A. The joint gear 11*g* engages the fixing gear 18. The double-gear 19 includes two gears. One of the two gears of the double-gear 19 engages the fixing gear 18. Another one of the two gears of the double-gear 19 engages the shaft driving gear 20. The driving transmission shaft 21 serves as a rotatable shaft mounted with the shaft driving gear 20 and the one-way gear 22. The one-way gear 22 engages the separation roller gear 23.

The second transmission 14*t* includes the joint gear 14*g*, the pressing idler gear 24, and the pressing gear 25. The joint gear 14*g* is connected to the second motor 14*m* depicted in FIG. 15A, and engages the pressing idler gear 24. The pressing idler gear 24 engages the pressing gear 25.

The following describes transmission of a driving force in the first driving system 11*s* depicted in FIG. 15A. The first motor 11*m* generates and transmits a driving force to the joint gear 11*g* connected to the first motor 11*m*. Thereafter, as illustrated in FIG. 16A, the joint gear 11*g* transmits the driving force to the fixing gear 18 directly. As illustrated in FIG. 16D, the one-way clutch 18*a* is provided inside the fixing gear 18. The driving force is transmitted to the flange 12*a* of the fixing roller 12 via the one-way clutch 18*a* serving as a first one-way clutch. Thus, the fixing roller 12 receives the driving force and rotates.

As illustrated in FIG. 16A, the fixing gear 18 transmits the driving force to the double-gear 19. The double-gear 19 amplifies a number of rotations (e.g., the RPM) caused by the driving force, and transmits the driving force to the shaft driving gear 20. The shaft driving gear 20 transmits the driving force to the driving transmission shaft 21. The driving transmission shaft 21 transmits the driving force to the one-way gear 22 via the one-way clutch 22*a* serving as a second one-way clutch as illustrated in FIG. 16E. Finally, the one-way gear 22 transmits the driving force to the separation roller gear 23 to rotate the separation roller 13 depicted in FIG. 15A.

The one-way clutches 18*a* and 22*a* provide directional coupling. Specifically, when a gear of a driving shaft rotates faster than a gear of a driven shaft, the one-way clutches 18*a* and 22*a* clutch both gears to transmit the driving force. By contrast, when the gear of the driving shaft rotates slower than the gear of the driven shaft, the one-way clutches 18*a* and 22*a* release clutching of both gears to idle so as not to transmit the driving force. For example, when the fixing gear 18 serving as the gear of the driving shaft rotates faster than the flange 12*a* serving as the gear of the driven shaft, the one-way clutch 18*a* transmits the driving force generated by the first motor 11*m* in a state in which the one-way clutch 18*a* clutches both gears. By contrast, when the fixing gear 18 rotates slower than the flange 12*a*, the one-way clutch 18*a* releases clutching of both gears to idle so as not to transmit the driving force generated by the first motor 11*m*. On the other hand, when the shaft driving gear 20 serving as the gear of the driving shaft rotates faster than the one-way gear 22 serving as the gear of the driven shaft, the one-way clutch 22*a* transmits the driving force generated by the first motor 11*m* in a state in which the one-way clutch 22*a* clutches both gears. By contrast, when the shaft driving gear 20 rotates slower than the one-way gear 22, the one-way clutch 22*a* releases clutching of both gears to idle so as not to transmit the driving force generated by the first motor 11*m*.

When the one-way clutches 18*a* and 22*a* clutch (e.g., lock) the gears, a gear ratio of the double-gear 19 is set in such a manner that a circumferential velocity Vf of the fixing roller 12 is smaller than a circumferential velocity Vs of the separation roller 13 to satisfy a following formula (3).

$$Vs > Vf \tag{3}$$

Accordingly, when a circumferential velocity Vp of the pressing roller 14 is greater than the circumferential velocity Vf of the fixing roller 12, the one-way clutch 18*a* idles, and the fixing roller 12 rotates in accordance with rotation of the pressing roller 14.

When the circumferential velocity Vp of the pressing roller 14 is greater than the circumferential velocity Vs of the separation roller 13, the one-way clutch 22*a* idles, and the separation roller 13 rotates in accordance with rotation of the pressing roller 14.

On the other hand, in the second driving system 14*s* illustrated in FIG. 15A, the second motor 14*m* transmits a driving force to the joint gear 14*g* connected to the second motor 14*m*. Thereafter, as illustrated in FIG. 16A, the joint gear 14*g* transmits the driving force to the pressing idler gear 24. The pressing idler gear 24 transmits the driving force to the pressing gear 25. Since no one-way clutch is provided inside the pressing idler gear 24 and the pressing gear 25, the pressing gear 25 transmits the driving force to a flange of the pressing roller 14 straight. Thus, the pressing roller 14 receives the driving force and rotates.

As illustrated in FIG. 15A, with the above-described structure, the first driving system 11*s* and the second driving system 14*s* independently drive and control the fixing belt unit 11U and the pressing roller 14, respectively. The fixing roller 12 and the separation roller 13 receive the driving force via the one-way clutches 18*a* and 22*a*, respectively. Accordingly, even when the circumferential velocity Vp of the pressing roller 14 is set to be greater than the circumferential velocities Vf and Vs of the fixing roller 12 and the separation roller 13, respectively, the fixing roller 12 and the separation roller 13 rotate in accordance with rotation of the pressing roller 14, and therefore the circumferential velocities Vf and Vs of the fixing roller 12 and the separation roller 13, respectively, are not smaller than the circumferential velocity Vp of the pressing roller 14. In other words, a relative velocity difference between the fixing belt unit 11U and the pressing roller 14 is decreased at the nip portion N1, preventing formation of a faulty image at the intermediate nip region I of the nip portion N1 depicted in FIG. 3.

Driving of the first driving system 11*s* and/or the second driving system 14*s* may be controlled to satisfy a following formula (4) when the fixing device 5 conveys a sheet P.

$$Vs \geqq Vp > Vf \tag{4}$$

Figure 17:
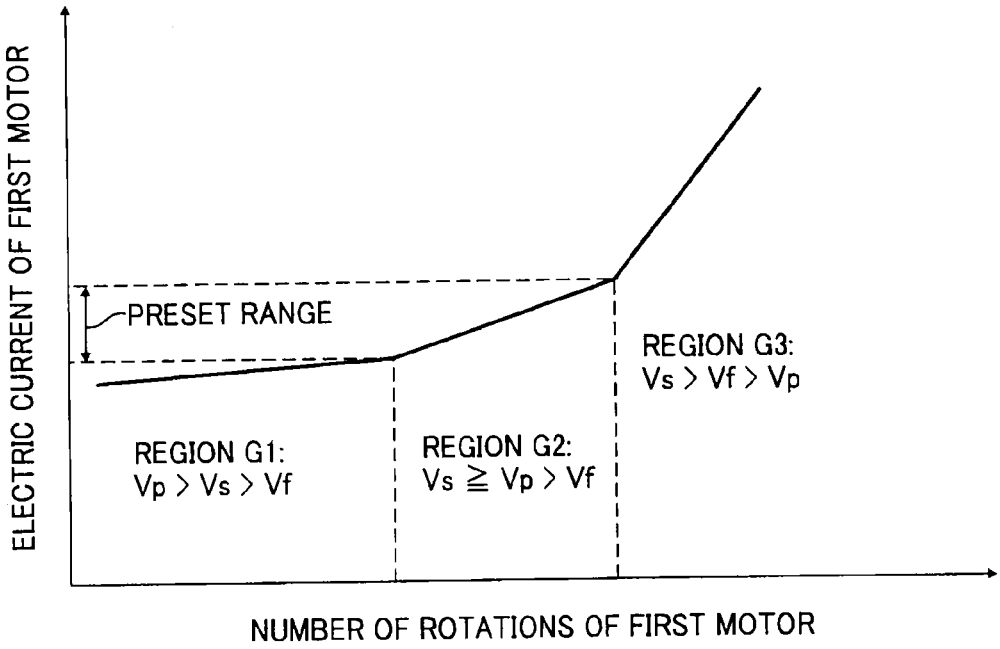
FIG. 17 is a graph illustrating a relation between a number of rotations of a first motor included in the fixing device shown in FIG. 15A and electric current of the first motor.

FIG. 17 is a graph illustrating a relation between the number of rotations (e.g., the RPM) of the first motor 11*m* depicted in FIG. 15A and electric current of the first motor 11*m*. The number of rotations of the first motor 11*m* is set by the gear ratio of the double-gear 19 depicted in FIG. 16A in such a manner that the circumferential velocity Vs of the separation roller 13 depicted in FIG. 15A is greater than the circumferential velocity Vf of the fixing roller 12 depicted in FIG. 15A under the constant number of rotations (e.g., the RPM) of the pressing roller 14 depicted in FIG. 15A. The electric current of the first motor 11*m* may be electric power or torque. FIG. 17 shows a relation between the circumferential velocities Vf and Vs of the fixing roller 12 and the separation roller 13, respectively, and the circumferential velocity Vp of the pressing roller 14 when the one-way clutches 18*a* and 22*a* clutch (e.g., lock) the gears.

Basically, the relation between the number of rotations of the first motor 11*m* and the electric current of the first motor 11*m* shows a proportional relation in which the greater the number of rotations of the first motor 11*m*, the greater the electric current of the first motor 11*m*. However, inclination (e.g., an increase rate) of a line showing the proportional relation is divided into three regions according to the relation among the circumferential velocities Vf, Vs, and Vp of the fixing roller 12, the separation roller 13, and the pressing roller 14, respectively.

Specifically, when the number of rotations of the first motor 11*m* is small, the relation among the circumferential velocities Vf, Vs, and Vp of the fixing roller 12, the separation roller 13, and the pressing roller 14, respectively, is shown by a following formula (5).

$$Vp>Vs>Vf \quad (5)$$

Actions of the one-way clutches 18*a* and 22*a* depicted in FIGS. 16D and 16E rotate the fixing roller 12 and the separation roller 13, respectively, in accordance with rotation of the pressing roller 14. Therefore, the torque, that is, the electric current or the electric power, of the first motor 11*m* is small, and the torque of the first motor 11*m* is also small in a region G1. As long as the fixing roller 12 and the separation roller 13 rotate in accordance with rotation of the pressing roller 14, even when the number of rotations of the first motor 11*m* increases, the electric current, the electric power, or the torque increases slightly. The torque means torque to be output by the first motor 11*m* according to an instruction issued by a driver controller of the fixing device 5 to a controller (e.g., the motor controller 200 depicted in FIG. 15B) connected to the first motor 11*m*.

When the number of rotations of the first motor 11*m* is increased, the circumferential velocity Vs of the separation roller 13 is greater than the circumferential velocity Vp of the pressing roller 14 according to the above formula (3). Accordingly, the circumferential velocities Vf, Vs, and Vp of the fixing roller 12, the separation roller 13, and the pressing roller 14, respectively, have a relation indicated by a following formula (6) in a region G2.

$$Vs \geqq Vp>Vf \quad (6)$$

Thus, in the first driving system 11*s*, the one-way clutch 18*a* idles, and the fixing roller 12 rotates in accordance with rotation of the pressing roller 14. The one-way clutch 22*a* clutches the one-way gear 22 depicted in FIG. 16E to transmit the driving force generated by the first motor 11*m* to the separation roller 13. The torque, that is, the electric current, the electric power, or the torque, of the first motor 11*m* increases by a driving amount of the separation roller 13. Thus, the inclination of the line in the region G2 is greater than the inclination in the region G1.

When the number of rotations of the first motor 11*m* is increased further, the circumferential velocity Vf of the fixing roller 12 is greater than the circumferential velocity Vp of the pressing roller 14. Accordingly, the circumferential velocities Vf, Vs, and Vp of the fixing roller 12, the separation roller 13, and the pressing roller 14, respectively, have a relation indicated by a following formula (7) in a region G3.

$$Vs>Vf>Vp \quad (7)$$

Thus, in the first driving system 11*s*, the one-way clutches 18*a* and 22*a* clutch the fixing gear 18 and the one-way gear 22 (depicted in FIG. 16A) to transmit the driving force generated by the first motor 11*m* to the fixing roller 12 and the separation roller 13, respectively. The torque value, that is, the electric current, the electric power, or the torque, of the first motor 11*m* increases sharply by a driving amount of the fixing roller 12 and the separation roller 13. Accordingly, the inclination of the line in the region G3 is greater than the inclination in the region G2.

In the region G1, the separation roller 13 rotates in accordance with rotation of the pressing roller 14, and does not stretch the fixing belt 11. Accordingly, the fixing belt 11 sags at the intermediate nip region I provided between the first nip region F and the second nip region S of the nip portion N1, and does not apply proper pressure to a sheet P conveyed on the fixing belt 11. Consequently, a toner image T fixed on the sheet P may have orange peel finish, resulting in a faulty fixed toner image. Further, the fixing roller 12 and the separation roller 13 rotating in accordance with rotation of the pressing roller 14 may unfavorably increase load to the second motor 14*m* of the second driving system 14*s* depicted in FIG. 15A substantially.

The fixing roller 12 rotating faster than the pressing roller 14 in the region G3 causes a relative velocity difference between the fixing belt 11 and the pressing roller 14. Accordingly, the fixing belt 11 may scratch the fixed toner image T on the sheet P, resulting in formation of a faulty fixed toner image. The fixing roller 12 and the pressing roller 14 rotate in a state in which the pressing roller 14 dents the thick, heat-resistant elastic layer 12E (depicted in FIG. 2) formed of silicon rubber foam or the like of the fixing roller 12. Accordingly, the velocity of the fixing roller 12 may fluctuate easily, resulting in unstable rotation of the fixing roller 12. Therefore, when the fixing roller 12 and the pressing roller 14 are driven independently and separately from each other as shown in the region G3, substantial fluctuation in the number of rotations (e.g., the RPM) of the fixing roller 12 may unfavorably increase load to the first motor 11*m* and the second motor 14*m*.

The above problems may be solved in the region G2. Since the circumferential velocity Vp of the pressing roller 14 is greater than the circumferential velocity Vf of the fixing roller 12 in the region G2, the fixing roller 12 rotates in accordance with rotation of the pressing roller 14, stabilizing rotation of the fixing roller 12 and causing no relative velocity difference between the fixing roller 12 and the pressing roller 14. Thus, a faulty fixed toner image, such as a scratched toner image, may not be formed.

Further, the second driving system 14*s* drives the pressing roller 14, and the driven pressing roller 14 drives the fixing roller 12, preventing or reducing fluctuation in the number of rotations of the fixing roller 12. Thus, unnecessary load may not be applied to the first motor 11*m* and the second motor 14*m*.

In the region G2, the circumferential velocity Vs of the separation roller 13 is greater than the circumferential velocity Vp of the pressing roller 14. In other words, the separation roller 13 rotates faster than the pressing roller 14. Since the diameter of the separation roller 13 is smaller than the diameter of the fixing roller 12, and the circumferential velocity Vp of the pressing roller 14 is greater than the circumferential velocity Vf of the fixing roller 12, the circumferential velocity Vp of the pressing roller 14 determines the conveyance velocity at the nip portion N1 for conveying a sheet P. Further, at the nip portion N1 at which the pressing roller 14 contacts the fixing belt 11, the surfaces of the pressing roller 14 and the fixing belt 11 move at an identical velocity. Accordingly, the separation roller 13 rotates and slides over an inner circumferential surface of the fixing belt 11 while stretching the fixing belt 11 against the nip portion N1. Consequently, the rotating separation roller 13 adjusts nip pressure at the intermediate nip region I of the nip portion N1 to predetermined pressure by stretching the fixing belt 11, preventing formation of a faulty fixed toner image having orange peel finish, for example. In order to stretch the fixing belt 11 properly, friction coefficient of the surfaces of the separation roller 13 and the fixing belt 11 may be considered. For example, the separation roller 13 may include silicon rubber.

As described above, when the circumferential velocities Vf, Vs, and Vp of the fixing roller 12, the separation roller 13, and the pressing roller 14, respectively, have the relation indicated by the above formula (4), that is, Vs≧Vp>Vf, the fixing belt 11 may not scratch a toner image on a sheet, preventing formation of a faulty fixed toner image having orange peel finish, for example. Further, load applied to the first motor 11*m* and the second motor 14*m* may be decreased, resulting in an improved load balance.

For example, as illustrated in FIGS. 15A and 15B, the motor controller 200 controls the second driving system 14*s* to drive and rotate the pressing roller 14 at the constant circumference velocity Vp. The motor controller 200 controls the first driving system 11*s* to drive the fixing roller 12 and the separation roller 13 in such a manner that the circumferential velocities Vf and Vs of the fixing roller 12 and the separation roller 13, respectively, satisfy the above formula (4). Alternatively, the motor controller 200 may control the second driving system 14*s* to drive the pressing roller 14 to satisfy the above formula (4) because the double-gear 19 is configured to cause the circumferential velocity Vs of the separation roller 13 to be greater than the circumferential velocity Vf of the fixing roller 12.

The circumferential velocities Vf, Vs, and Vp of the fixing roller 12, the separation roller 13, and the pressing roller 14, respectively, may fluctuate due to difference in temperature, thermal expansion, and denting of the pressing roller 14, the separation roller 13, and the fixing roller 12. Therefore, it is difficult to drive the pressing roller 14, the separation roller 13, and the fixing roller 12 to satisfy the above formula (4) constantly under a constant driving condition of the first motor 11*m* and the second motor 14*m*.

To address this, the fixing device 5 includes the first motor detector 11*m*D and the first motor regulator 11*m*A. The first motor detector 11*m*D detects one of the electric current, the electric power, and the torque of the first motor 11*m* serving as a servomotor. The first motor regulator 11*m*A changes the number of rotations of the first motor 11*m*.

Specifically, when a sheet P is conveyed, the motor controller 200 performs feed-back control to cause the first motor regulator 11*m*A to change the number of rotations of the first motor 11*m* to a number of rotations (e.g., the RPM) corresponding to a predetermined range (e.g., a preset range) based on a detection result provided by the first motor detector 11*m*D, so that the circumferential velocities Vf, Vs, and Vp of the fixing roller 12, the separation roller 13, and the pressing roller 14, respectively, satisfy the relation indicated by the above formula (4). The predetermined range of the number of rotations of the first motor 11*m* means a range of the electric current, the electric power, or the torque of the first motor 11*m* in the region G2 depicted in FIG. 17.

More specifically, in the fixing device 5, the number of rotations of the first motor 11*m* and the electric current, the electric power, or the torque of the first motor 11*m* have the relation illustrated in the graph in FIG. 17. Accordingly, the first motor detector 11*m*D detects one of the electric current, the electric power, the torque of the first motor 11*m*. When a detected value provided by the first motor detector 11*m*D is not in the predetermined range (e.g., the preset range), the first motor regulator 11*m*A changes the number of rotations of the first motor 11*m* to a number of rotations (e.g., the RPM) corresponding to the predetermined range.

For example, when the detected value is in the region G1, the first motor regulator 11*m*A increases the number of rotations of the first motor 11*m*. By contrast, when the detected value is in the region G3, the first motor regulator 11*m*A decreases the number of rotations of the first motor 11*m*. Thus, the relation indicated by the above formula (4) is satisfied.

The above-described control may be performed continuously when sheets P are conveyed. Alternatively, the control may be performed periodically or whenever an image formation mode (e.g., the gloss mode or the non-gloss mode) is switched.

In the fixing device 5, control for satisfying the relation indicated by the above formula (4) may be performed with a structure in which the one-way clutch 18*a* is provided inside the fixing gear 18 of the first driving system 11*s*. However, as illustrated in FIG. 15A, when the fixing device 5 is turned on to start driving the second driving system 14*s* for driving the pressing roller 14 and the first driving system 11*s* for driving the fixing belt unit 11U, the first motor 11*m* may not be connected to the joint gear 11*g* precisely depending on a state in which the fixing belt unit 11U is attached to the fixing device 5. In this case, the first motor 11*m* may be connected to the joint gear 11*g* after the first motor 11*m* starts rotating and rotates for a certain amount. Accordingly, some time lag may generate between start of rotating the pressing roller 14 and start of rotating the fixing roller 12 and the separation roller 13 included in the fixing belt unit 11U. During the time lag, the separation roller 13 stops while the pressing roller 14 rotates, and therefore the separation roller 13 and the fixing belt 11 may receive a shearing force generated by the pressing roller 14. To address this, the one-way clutch 22*a* may be favorably mounted on the one-way gear 22, as illustrated in FIG. 16E. In other words, when the motor controller 200 starts driving the second driving system 14*s*, the second driving system 14*s* rotates the pressing roller 14, and the one-way clutches 18*a* and 22*a* cause the fixing roller 12 and the separation roller 13 to rotate in accordance with rotation of the pressing roller 14. Thereafter, the motor controller 200 starts driving the first driving system 11*s* for driving the fixing belt unit 11U. Thus, the above-described problems may be solved.

Figure 18:
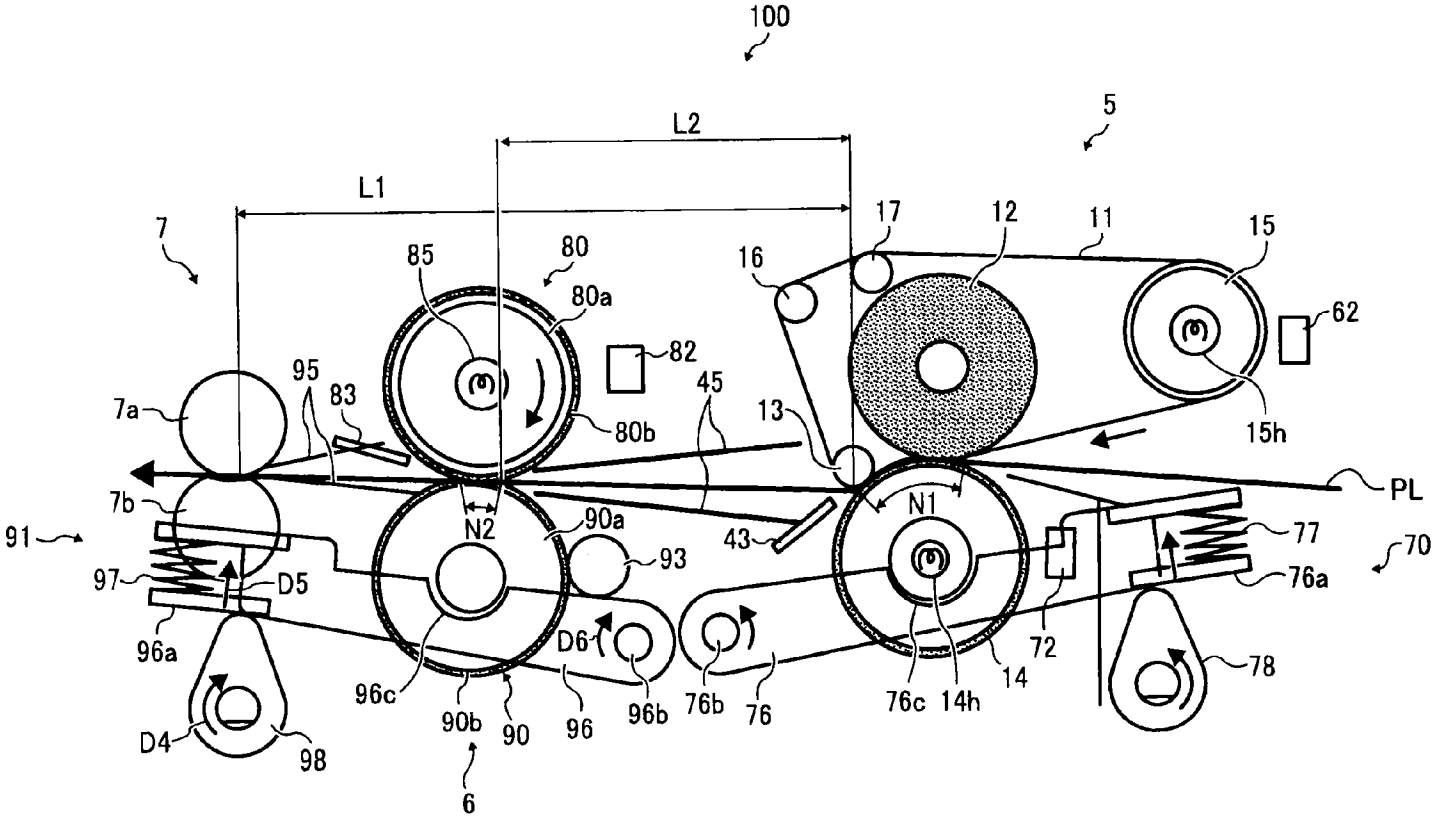
FIG. 18 is a schematic view of a fixing device, a gloss finisher, and a conveyance roller pair included in the image forming apparatus shown in FIG. 1.

FIG. 18 is a schematic view of the fixing device 5, the gloss finisher 6, and the conveyance roller pair 7 included in the image forming apparatus 100 shown in FIG. 1.

As illustrated in FIG. 18, the image forming apparatus 100 further includes guides 45 and 95.

The gloss finisher 6 includes a heating roller 80, a temperature sensor 82, a separator 83, a heater 85, a pressing roller 90, a pressure adjuster 91, and a cleaner 93. The heating roller 80 includes a core metal 80*a* and an elastic layer 80*b*. The pressing roller 90 includes a core metal 90*a* and an elastic layer 90*b*. The pressure adjuster 91 includes a pressing lever 96, a pressing member 96*a*, a support shaft 96*b*, a pressing portion 96*c*, a spring 97, and a cam 98.

The conveyance roller pair 7 includes rollers 7*a* and 7*b*.

The image forming apparatus 100 provides the gloss mode for applying gloss to a fixed toner image T on a sheet P, and the non-gloss mode for not applying gloss to the fixed toner image T. In the image forming apparatus 100, the fixing device 5, the gloss finisher 6, and the conveyance roller pair 7 are provided on a path line PL for conveying the sheet P in this order in the sheet conveyance direction. Alternatively, the fixing device 5' depicted in FIG. 4 may replace the fixing device 5.

The fixing device 5 includes the fixing belt 11 serving as a rotatable fixing member, and the pressing roller 14 serving as a pressing member for pressing against the fixing member to form the nip portion N1 for fixing the toner image T on the sheet P.

The gloss finisher 6 includes the heating roller 80 serving as a first rotary member or a heating member, the heater 85 serving as a heater provided inside the first rotary member, and the pressing roller 90 serving as a second rotary member or a pressing member pressed against the first rotary member to form a nip portion N2 for applying gloss to the fixed toner image T on the sheet P.

The conveyance roller pair 7 is provided at a position separated from a downstream end of the nip portion N1 of the fixing device 5 in the sheet conveyance direction by a distance L1 (e.g., 210 mm) or smaller, and feeds the sheet P sent from the gloss finisher 6.

In the non-gloss mode, when a length of the sheet P is smaller than 210 mm in the sheet conveyance direction, the gloss finisher 6 decreases nip pressure applied by the pressing roller 90 to the heating roller 80 to a level lower than nip pressure applied by the pressing roller 90 to the heating roller 80 in the gloss mode, so that the pressing roller 90 and the heating roller 80 feed the sheet P. When the length of the sheet P is not smaller than 210 mm, the gloss finisher 6 releases the nip portion N2 formed between the pressing roller 90 and the heating roller 80, so that the conveyance roller pair 7 feeds the sheet P.

The following describes the fixing device 5. The fixing device 5 has the structure shown in FIG. 2. When the fixing belt 11 and the pressing roller 14 rotate, the surface of the fixing belt 11 is heated up to a predetermined temperature. When a sheet P bearing a toner image T passes through the nip portion N1 leftward in FIG. 18, the fixing belt 11 and the pressing roller 14 apply heat and pressure to the sheet P at the nip portion N1 to melt and fix the toner image T on the sheet P. When the sheet P bearing the toner image T is discharged from the nip portion N1, the separator 43 separates the sheet P from the pressing roller 14.

As described above by referring to FIGS. 15A and 15B, the motor controller 200 controls the first driving system 11*s* and the second driving system 14*s* to satisfy the relation indicated by the above formula (4), thus preventing formation of a faulty fixed toner image such as a scratched toner image and an orange peel toner image, decreasing load applied to the first motor 11*m* and the second motor 14*m*, and improving a load balance.

The sheet P discharged from the fixing device 5 is sent to the gloss finisher 6. The guide 45 is provided between the fixing device 5 and the gloss finisher 6. For example, the guide 45 includes two plate members provided above and below the path line PL, respectively, to form a gap through which the sheet P discharged from the fixing device 5 is conveyed to the gloss finisher 6. The gap becomes narrower toward the gloss finisher 6. The sheet P separated from the fixing belt 11 by the curvature of the separation roller 13 may curl easily. To address this, the guide 45 corrects curl of the sheet P to direct a leading edge of the sheet P toward the gloss finisher 6. Thus, the sheet P is not creased or jammed in the gloss finisher 6, providing stability in conveying the sheet P. According to this exemplary embodiment, the toner image T which is fixed on the sheet P properly by the fixing device 5 does not degrade even when the toner image T contacts the guide 45.

The following describes the gloss finisher 6. In the gloss finisher 6, the heater 85 is provided inside the heating roller 80 serving as a first rotary member having a hollow cylindrical shape. The pressing roller 90 serving as a second rotary member is pressed against the first rotary member to form the nip portion N2 at which the heating roller 80 and the pressing roller 90 apply heat and pressure to the fixed toner image T on the sheet P to apply gloss to the fixed toner image T.

In the heating roller 80, the elastic layer 80*b* including silicon rubber is provided on an outer circumferential surface of the core metal 80*a* having a cylindrical shape including aluminum or iron. The heater 85 is provided inside the core metal 80*a*.

In the pressing roller 90, the elastic layer 90*b* including silicon rubber is provided on an outer circumferential surface of the core metal 90*a* having a round-bar shape including aluminum or iron. The elastic layer 90*b* of the pressing roller 90 is thinner than the elastic layer 80*b* of the heating roller 80, and therefore fluctuation in surface temperature of the pressing roller 90 is smaller than fluctuation in surface temperature of the heating roller 80. Accordingly, the pressing roller 90 serves as a primary driving roller of the gloss finisher 6.

The temperature sensor 82 is provided to face the heating roller 80 at a position near an entrance to the nip portion N2 to detect surface temperature of the heating roller 80 at a position upstream from the nip portion N2 in a rotation direction of the heating roller 80. The heater 85 (e.g., a halogen heater) is turned on and off based on the detected surface temperature to maintain the constant surface temperature of the heating roller 80.

The surface temperature of the heating roller 80 is controlled to apply gloss to the fixed toner image T properly in the gloss mode. For example, the surface temperature of the heating roller 80 contacting the fixed toner image T on the sheet P is lower than the surface temperature of the fixing belt 11 serving as a fixing member of the fixing device 5. Alternatively, the surface temperature of the heating roller 80 may be favorably not lower than a temperature of the sheet P entering the gloss finisher 6 and not higher than a temperature of the sheet P immediately after the sheet P is discharged from the fixing device 5.

The surface temperature of the heating roller 80 may be preferably not lower than a softening temperature of toner used to form the toner image T which is measured by a flow tester and not higher than a half-flow start temperature at which half of the toner starts flowing, and more preferably not lower than the softening temperature and not higher than a flow start temperature at which the toner starts flowing. A solid-state temperature of the toner may be measured with a flow tester model CFT-500D available from Shimadzu Corporation under a load of 5 kg/cm$^2$, a temperature increase velocity of 3.0 degrees centigrade per minute, a die diameter of 1.0 mm, a die length of 10.0 mm, and may be calculated based on a relation between temperature and piston stroke. The half-flow start temperature at which half of the toner starts flowing is defined as a midpoint between the flow start temperature at which the toner starts flowing and a flow finish temperature at which the toner finishes flowing.

For example, the surface temperature of the heating roller 80 may be preferably in a range from 60 degrees centigrade (e.g., a softening temperature in the solid-state temperature of the toner) to 137 degrees centigrade (e.g., a half-flow start temperature in the solid-state temperature of the toner), more preferably in a range from 60 degrees centigrade to 120 degrees centigrade (e.g., a flow start temperature in the solid-state temperature of the toner), and yet more preferably in a range from 80 degrees centigrade to 100 degrees centigrade. The temperature (e.g., the solid-state temperature) of toner fluctuates depending on lot and color of the toner. The above-mentioned temperatures are average temperatures.

According to this exemplary embodiment, in a fixing process in which a sheet P passes through the fixing device 5, an unfixed toner image T on the sheet P receives heat and pressure at the nip portion N1, and therefore an entire toner layer forming the unfixed toner image T from an upper surface of the unfixed toner image T to a lower surface of the unfixed toner image T contacting the sheet P is melted and fixed.

Certain leveling adheres the toner image T to the sheet P, and a substantial adhesive force generates on the upper surface of the toner image T.

By contrast, in a gloss application process in which the sheet P passes through the gloss finisher 6, the toner image T has already been fixed on the sheet P, and therefore the gloss finisher 6 applies heat needed to level the surface of the toner image T. The toner image T on the sheet P receives heat and pressure at the nip portion N2 in the gloss finisher 6. However, the surface temperature of the heating roller 80 is not lower than the temperature of the sheet P when the sheet P enters the gloss finisher 6 and not higher than the temperature of the sheet P immediately after the sheet P is discharged from the fixing device 5. In other words, the surface temperature of the heating roller 80 is not lower than the softening temperature of the toner forming the toner image T measured by the flow tester and not higher than the half-flow start temperature at which half of the toner starts flowing, or the surface temperature of the heating roller 80 is in a range from about 60 degrees centigrade to about 120 degrees centigrade. Accordingly, the entire toner layer is not melted, but the surface layer of the toner image T is softened. Consequently, color of the toner image T is maintained, and the smooth surface of the heating roller 80 levels the surface layer of the toner image T to improve the gloss of the toner image T. The surface of the toner image T provides an adhesive force smaller than the adhesive force provided in the fixing process. Accordingly, even when a diameter of the heating roller 80 is not smaller than about 30 mm and not greater than about 40 mm, the sheet P bearing the toner image T separates from the heating roller 80 properly. Namely, the separator 83 provided downstream from the nip portion N2 in the sheet conveyance direction may be omitted to simplify the structure of the gloss finisher 6 and reduce manufacturing costs. Further, offset caused by melting the entire toner layer in the fixing process does not generate in the gloss application process. Accordingly, the cleaner 93 for removing toner from a surface of the pressing roller 90 may be omitted to simplify the structure of the gloss finisher 6 and reduce manufacturing costs.

The pressing roller 90 may be a cylindrical roller in which the elastic layer 90*b* including silicon rubber is provided on the core metal 90*a* including aluminum or iron. The pressure adjuster 91 includes the pressing lever 96, the pressing member 96*a*, the support shaft 96*b*, the pressing portion 96*c*, the spring 97, and the cam 98, and contacts the pressing roller 90 to press the pressing roller 90 against the heating roller 80 in the gloss mode.

The following describes operations of the pressure adjuster 91. When a driving force generated by an external device rotates the cam 98 clockwise in FIG. 18 in a rotation direction D4 by a predetermined angle, the cam 98 pushes up the pressing member 96*a* in a direction D5. The pressing member 96*a* causes the spring 97 mounted on the pressing member 96*a* to push up one end of the pressing lever 96 in a direction perpendicular to an axial direction of the pressing roller 90 with predetermined pressure. Accordingly, the pressing lever 96 rotates about the support shaft 96*b* clockwise in FIG. 18 in a rotation direction D6. Thereafter, the pressing portion 96*c* provided between one end of the pressing lever 96 mounting the spring 97 and the support shaft 96*b* contacts a shaft of the pressing roller 90 and pushes the pressing roller 90 toward the heating roller 80. Finally, the pressing roller 90 contacts the heating roller 80 and presses against the heating roller 80 with predetermined pressure to form the nip portion N2 for applying gloss to the toner image T on the sheet P. Alternatively, the pressure adjuster 91 may not include the spring 97 so that the cam 98 directly pushes up one end of the pressing lever 96.

The rotation angle of the cam 98 is adjusted to change pressure applied by the pressure adjuster 91. Specifically, when the cam 98 is at a predetermined rotation position, the pressing roller 90 separates from the heating roller 80 to release the nip portion N2.

In the gloss mode, the pressure adjuster 91 may adjust nip pressure applied at the nip portion N2 to a value in a range from about 15 N/cm$^2$ to about 30 N/cm$^2$. Accordingly, when the sheet P sent from the fixing device 5 passes through the gloss finisher 6, heat and predetermined pressure are applied to the fixed toner image T on the sheet P at the nip portion N2 to level the surface layer of the fixed toner image T to apply gloss to the fixed toner image T.

When a sheet P having a length smaller than 210 mm is used in the non-gloss mode, the pressure adjuster 91 adjusts the nip pressure applied at the nip portion N2 to a value smaller than the nip pressure applied at the nip portion N2 in the gloss mode, for example, preferably smaller than about 15 N/cm$^2$ and more preferably not greater than about 5 N/cm$^2$. The nip pressure applied at the nip portion N2 is defined as average pressure applied at a whole nip length of the nip portion N2. Accordingly, the heating roller 80 and the pressing roller 90 nip the sheet P with the small nip pressure to convey the sheet P without increasing gloss of the fixed toner image T on the sheet P.

When a sheet P having a length not smaller than 210 mm is used in the non-gloss mode, the pressure adjuster 91 may release the nip portion N2, that is, pressure applied between the heating roller 80 and the pressing roller 90.

In the non-gloss mode, an A3 size sheet having a weight not greater than about 80 g/m$^2$ may be used as a thin long sheet P. However, a slight difference between the linear velocities of the fixing device 5 and the gloss finisher 6 for conveying the sheet P may bend or stretch the sheet P, creasing the sheet P slightly. To address this, the pressing roller 90 separates from the heating roller 80 in the gloss finisher 6. In this case, the sheet P passes through the gloss finisher 6 without receiving pressure at the nip portion N2. Specifically, a leading edge of the sheet P having the length not smaller than 210 mm discharged from the nip portion N1 of the fixing device 5 reaches the conveyance roller pair 7, and the conveyance roller pair 7 nips and conveys the sheet P. Thus, chances of the toner image T on the sheet P to contact the rollers (e.g., the heating roller 80 and the pressing roller 90) are decreased to maintain image quality and convey the sheet P precisely.

A roller gap provided between the heating roller 80 and the pressing roller 90 when the nip portion N2 is released may be not greater than about 2 mm. When the roller gap is greater than about 2 mm, the sheet P may go off the path line PL and may be jammed.

A surface layer of each of the heating roller 80 and the pressing roller 90 may be coated with fluorocarbon resin. Specifically, even when the pressing roller 90 separates from the heating roller 80 to provide the roller gap not greater than about 2 mm in the non-gloss mode, and the toner image T on the sheet P contacts the heating roller 80 partially while the sheet P passes through the roller gap, the surface layer coated with the fluorocarbon resin may release the sheet P from the heating roller 80 easily, and may prevent the heating roller 80 from scratching the toner image T on the sheet P.

As described above, the gloss finisher 6 provides desired gloss stably in the gloss mode, and improves reliability of the desired gloss in each of the gloss mode and the non-gloss mode.

The gloss finisher 6 (e.g., the heating roller 80 and the pressing roller 90) is disposed at a position at which the leading edge of the sheet P reaches the nip portion N2 of the gloss finisher 6 before a trailing edge of the sheet P leaves the nip portion N1 of the fixing device 5. For example, a distance L2 from the exit of the nip portion N1 to the entrance to the nip portion N2 may be preferably in a range from about 60 mm to about 182 mm, more preferably in a range from about 70 mm to about 150 mm, and yet more preferably in a range from about 80 mm to about 100 mm. When the distance L2 is smaller than about 60 mm, the two plate members of the guide 45 may tilt sharply to provide a predetermined opening gap at an entrance to the guide 45 and another predetermined opening gap at an exit of the guide 45. Thus, the sheet P may be jammed in the guide 45 easily. An upper limit of the distance L2 may be a length of a smallest sheet which can be handled by the image forming apparatus 100. For example, the distance L2 of 182 mm is a distance corresponding to a short length of a B5 size sheet when the B5 size sheet is conveyed in a short direction of the B5 size sheet. The upper limit of the distance L2 is 150 mm when a half letter size sheet is conveyed in a short direction of the half letter size sheet.

Figure 19A:
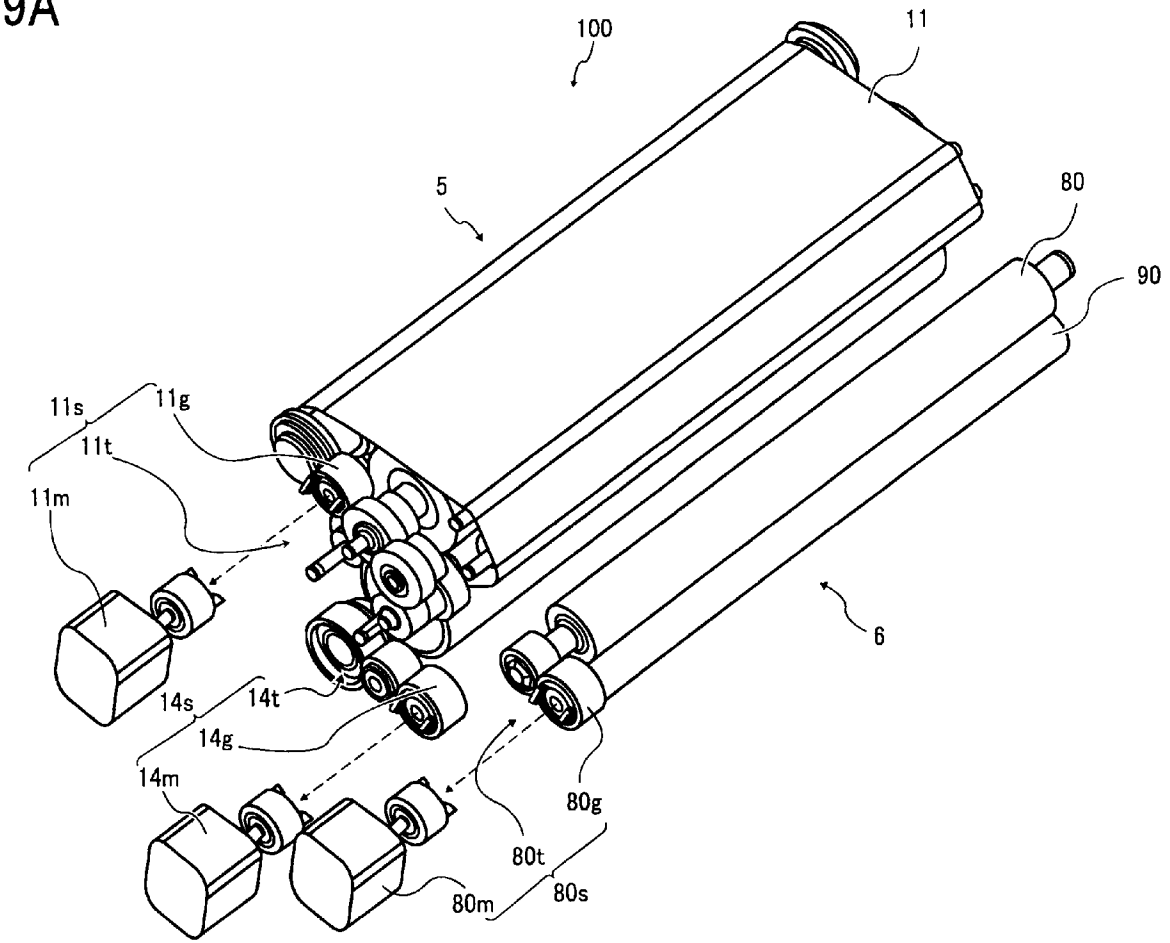
FIG. 19A is a perspective view of the fixing device and the gloss finisher shown in FIG. 18.

FIG. 19A is a perspective view of the fixing device 5 including the first driving system 11*s* and the second driving system 14*s*, and the gloss finisher 6 including a third driving system 80*s*. As illustrated in FIG. 19A, the third driving system 80*s* includes a joint gear 80*g*, a third motor 80*m*, and a third transmission 80*t*.

Figure 19B:
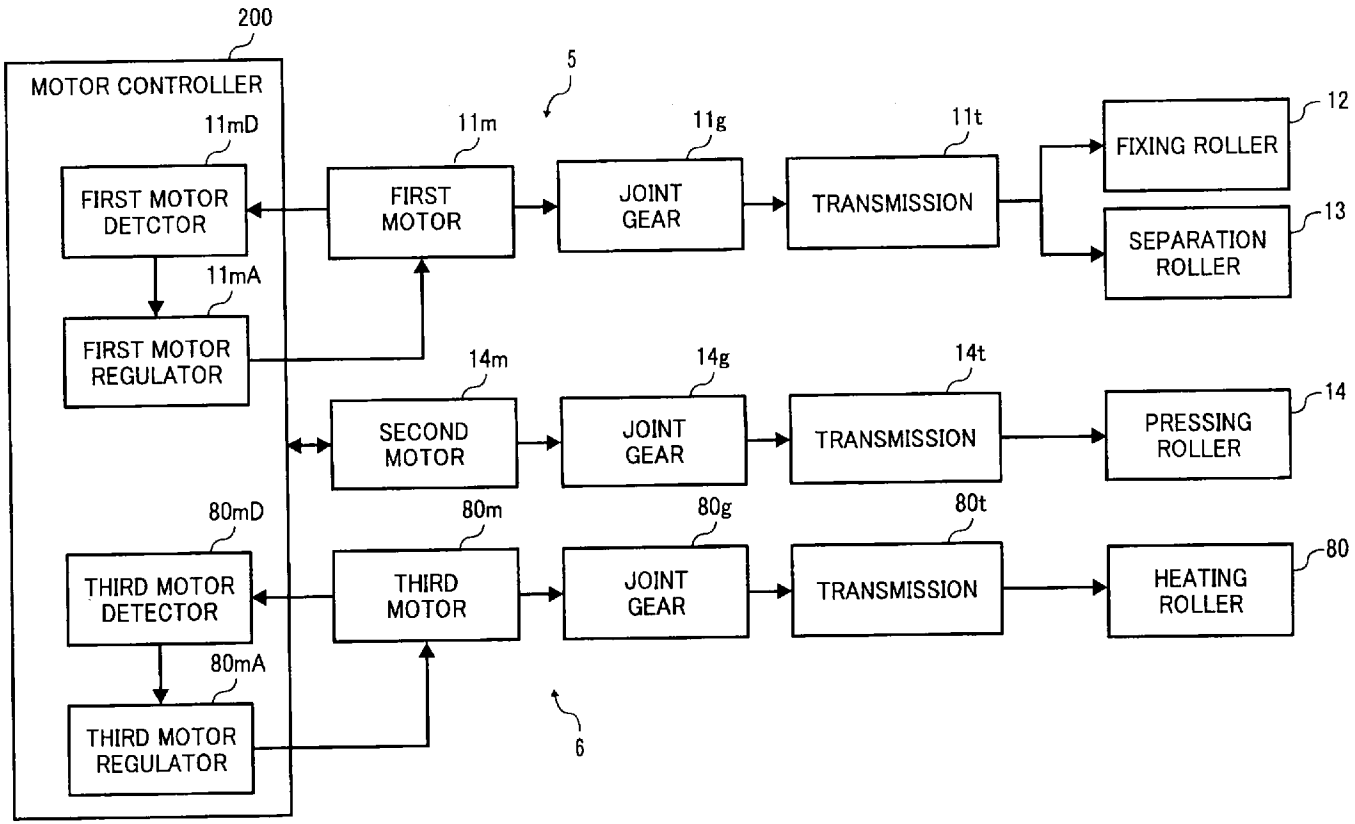
FIG. 19B is a block diagram of the fixing device and the gloss finisher shown in FIG. 19A.

FIG. 19B is a block diagram of the fixing device 5 and the gloss finisher 6. As illustrated in FIG. 19B, the motor controller 200 further includes a third motor detector 80*m*D and a third motor regulator 80*m*A.

The third driving system 80*s* drives the heating roller 80. In the third driving system 80*s*, the third transmission 80*t* includes one or more transmission gears, and transmits a driving force generated by the third motor 80*m* to the heating roller 80.

The third motor 80*m* is provided in the image forming apparatus 100. When the gloss finisher 6 is attached to the image forming apparatus 100, the third motor 80*m* is connected to the joint gear 80*g* serving as a driving force input portion of the heating roller 80.

With the above-described structure, the third transmission 80*t* transmits the driving force generated by the third motor 80*m* to the heating roller 80 via the joint gear 80*g*. Thus, the gloss finisher 6 is driven. According to this exemplary embodiment, the third driving system 80*s* drives the heating roller 80. Alternatively, the third driving system 80*s* may drive the pressing roller 90.

When "V1" represents a conveyance velocity at which the fixing device 5 conveys a sheet P, and "V2" represents a conveyance velocity at which the gloss finisher 6 conveys the sheet P, the third driving system 80*s* performs driving control satisfying a following formula (8).

$$1.05\times V1\square V2\square V1 \quad (8)$$

Figure 20:
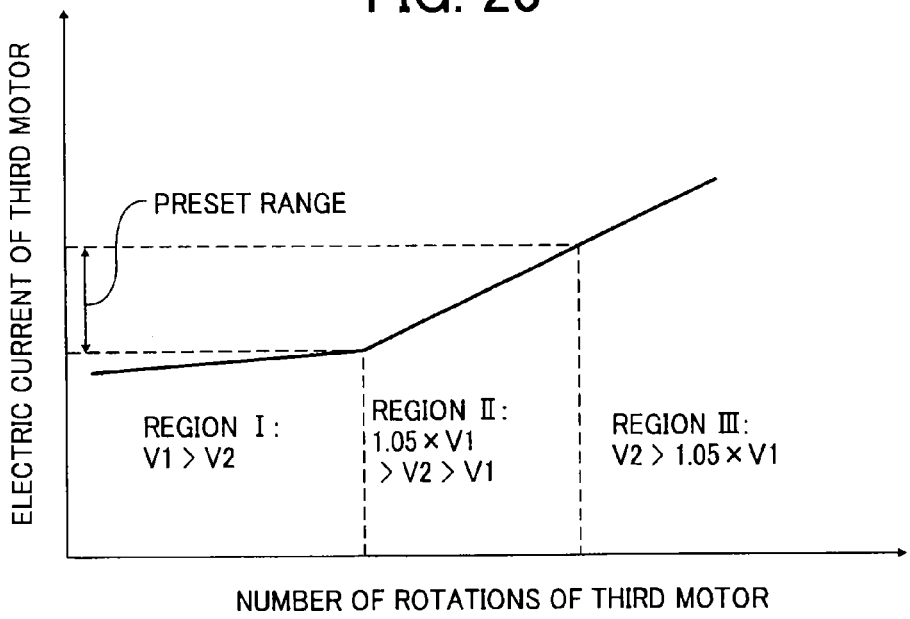
FIG. 20 is a graph illustrating a relation between a number of rotations of a third motor included in the gloss finisher shown in FIG. 19A and electric current of the third motor.

FIG. 20 is a graph illustrating a relation between a number of rotations (e.g., the RPM) of the third motor 80*m* and electric current of the third motor 80*m* in the gloss finisher 6 which receives a sheet P sent from the fixing device 5 at the predetermined conveyance velocity V1. The electric current of the third motor 80*m* may be electric power or torque. The graph illustrated in FIG. 20 also shows a relation between the conveyance velocity V1 at which the fixing device 5 conveys the sheet P and the conveyance velocity V2 at which the gloss finisher 6 conveys the sheet P.

Basically, the relation between the number of rotations of the third motor 80*m* and the electric current of the third motor 80*m* shows a proportional relation in which the greater the number of rotations of the third motor 80*m*, the greater the electric current of the third motor 80*m*. However, inclination (e.g., an increase rate) of a line showing the proportional relation is divided into three regions according to the relation between the conveyance velocities V1 and V2 for conveying the sheet P.

Specifically, when the number of rotations of the third motor 80*m* is small, the relation between the conveyance velocity V1 of the fixing device 5 and the conveyance velocity V2 of the gloss finisher 6 is shown by a following formula (9).

$$V1>V2 \quad (9)$$

The conveyance velocity V1 of the fixing device 5 has an ascendancy over the conveyance velocity V2 of the gloss finisher 6. Therefore, the torque, that is, the electric current or the electric power, of the third motor 80*m* is small, and the torque value of the third motor 80*m* is also small in a region I. Even when the number of rotations of the third motor 80*m* increases, the electric current, the electric power, or the torque of the third motor 80*m* increases slightly in the region I. The torque value is defined as torque to be output by the third motor 80*m* according to an instruction issued by a driver controller of the gloss finisher 6 to a controller (e.g., the motor controller 200 depicted in FIG. 19B) connected to the third motor 80*m*.

When the number of rotations of the third motor 80*m* is increased, the conveyance velocity V2 of the gloss finisher 6 is greater than the conveyance velocity V1 of the fixing device 5 to have a relation indicated by a following formula (10) in a region II.

$$1.05\times V1>V2>V1 \quad (10)$$

When the conveyance velocity V2 of the gloss finisher 6 increases further, the conveyance velocities V1 and V2 have a relation indicated by a following formula (11) in a region III.

$$V2>1.05\times V1 \quad (11)$$

In the regions II and III, the torque value of the third motor 80*m*, that is, the electric current, the electric power, or the torque of the third motor 80*m*, has an identical increase rate (e.g., inclination of the line) and is greater than the torque of the third motor 80*m* in the region I.

In the region I, the conveyance velocity V1 of the fixing device 5 for feeding the sheet P into the gloss finisher 6 is greater than the conveyance velocity V2 of the gloss finisher 6 for discharging the sheet P from the gloss finisher 6. Accordingly, the sheet P waves and slacks between the fixing device 5 and the gloss finisher 6. Consequently, the sheet P or the toner image T on the sheet P may have slack creases. On the other hand, in the region III, the conveyance velocity V2 of the gloss finisher 6 for discharging the sheet P from the gloss finisher 6 is excessively greater than the conveyance velocity V1 of the fixing device 5 for feeding the sheet P into the gloss finisher 6. Accordingly, the gloss finisher 6 pulls the sheet P with a substantial force. Consequently, the sheet P or the toner image T on the sheet P may have rib creases, that is, creases extending obliquely from edges toward a center of the sheet P.

In the region II, the gloss finisher 6 pulls the sheet P properly to prevent or reduce slack creases and rib creases. Namely, the conveyance velocity V2 of the gloss finisher 6 is greater than the conveyance velocity V1 of the fixing device 5 within 5 percent as shown by the above formula (8) to prevent or reduce visual faults such as slack creases and rib creases.

The conveyance velocities V1 and V2 of the fixing device 5 and the gloss finisher 6, respectively, may fluctuate due to difference in temperature, thermal expansion, denting of the pressing roller 14, the separation roller 13, the fixing roller 12, the heating roller 80, and the pressing roller 90 depicted in FIG. 18, and type of a sheet P. Therefore, it is difficult to drive the pressing roller 14, the separation roller 13, the fixing roller 12, the heating roller 80, and the pressing roller 90 to satisfy the above formula (8) under a constant driving condition of the first motor 11*m*, the second motor 14*m*, and the third motor 80*m* depicted in FIG. 19A.

To address this, as illustrated in FIG. 19B, the gloss finisher 6 includes the third motor detector 80*m*D and the third motor regulator 80*m*A. The third motor detector 80*m*D detects one of the electric current, the electric power, and the torque of the third motor 80*m*. The third motor regulator 80*m*A changes the number of rotations (e.g., the RPM) of the third motor 80*m*.

Specifically, when a sheet P is conveyed, the motor controller 200 performs feed-back control to cause the third motor regulator 80*m*A to change the number of rotations of the third motor 80*m* to a number of rotations (e.g., the RPM) corresponding to a predetermined range based on a detection result provided by the third motor detector 80*m*D, so that the conveyance velocities V1 and V2 of the fixing device 5 and the gloss finisher 6, respectively, satisfy the relation indicated by the above formula (8). The predetermined range of the number of rotations of the third motor 80*m* is defined as a range (e.g., a preset range) of the electric current, the electric power, or the torque of the third motor 80*m* in the region II depicted in FIG. 20.

More specifically, in the gloss finisher 6, the number of rotations of the third motor 80*m* and the electric current, the electric power, or the torque of the third motor 80*m* have the relation illustrated in the graph in FIG. 20. Accordingly, the third motor detector 80*m*D detects one of the electric current, the electric power, the torque of the third motor 80*m*. When a detected value provided by the third motor detector 80*m*D is not in the predetermined range (e.g., the preset range), the third motor regulator 80*m*A changes the number of rotations of the third motor 80*m* to a number of rotations (e.g., the RPM) corresponding to the predetermined range.

For example, when the detected value provided by the third motor detector 80*m*D is in the region I, the third motor regulator 80*m*A increases the number of rotations of the third motor 80*m*. By contrast, when the detected value provided by the third motor detector 80*m*D is in the region III, the third motor regulator 80*m*A decreases the number of rotations of the third motor 80*m*. Thus, the relation indicated by the above formula (8) is satisfied.

The above-described control may be performed continuously when sheets P are conveyed as long as the pressing roller 90 is pressed against the heating roller 80 in the gloss finisher 6. Alternatively, the control may be performed periodically or whenever the image formation mode (e.g., the gloss mode or the non-gloss mode) is switched.

As illustrated in FIG. 18, the sheet P discharged from or passed through the gloss finisher 6 is sent to the conveyance roller pair 7. The guide 95 is provided between the gloss finisher 6 and the conveyance roller pair 7. For example, the guide 95 includes two plate members provided above and below the path line PL, respectively, to form a gap through which the sheet P is conveyed. The gap becomes narrower toward the conveyance roller pair 7. The guide 95 corrects curl of the sheet P to direct the leading edge of the sheet P toward the conveyance roller pair 7. Thus, the sheet P is not creased or jammed in the conveyance roller pair 7, providing stability in conveying the sheet P.

Referring to FIG. 18, the following describes the conveyance roller pair 7. The conveyance roller pair 7 includes the cylindrical roller 7*a* including chloroprene rubber and/or silicon rubber and the cylindrical roller 7*b* including resin and contacting the roller 7*a*. One or both of the rollers 7*a* and 7*b* is driven to sandwich the sheet P sent from the gloss finisher 6 and feed the sheet P toward the output path. The conveyance roller pair 7 is disposed at a position downstream within 210 mm from the exit of the nip portion N1 of the fixing device 5 in the sheet conveyance direction. Accordingly, when the length of the sheet P in the sheet conveyance direction in the non-gloss mode is not smaller than 210 mm, that is, the length of an A4 size sheet in a short direction of the A4 size sheet, the nip portion N2 formed between the heating roller 80 and the pressing roller 90 of the gloss finisher 6 is released. However, the leading edge of the sheet P discharged from the nip portion N1 of the fixing device 5 reaches the conveyance roller pair 7 before the trailing edge of the sheet P leaves the nip portion N1. Thus, the sheet P is conveyed properly.

The surface temperature of the heating roller 80 is low, that is, not lower than a sheet temperature of the sheet P entering the gloss finisher 6 and not higher than a sheet temperature of the sheet P immediately after the sheet P is discharged from the fixing device 5, not lower than the softening temperature of toner used to form the toner image T which is measured by the flow tester and not higher than the half-flow start temperature at which half of the toner starts flowing, or not lower than about 60 degrees centigrade and not higher than about 120 degrees centigrade. Accordingly, in the gloss mode, the sheet temperature of the sheet P reaching the conveyance roller pair 7 is equivalent to or lower than the sheet temperature of the sheet P immediately after the sheet P is discharged from the fixing device 5. Consequently, the toner does not adhere to the conveyance roller pair 7. Further, due to the similar reason, the toner does not adhere to the guide 95.

Referring to FIG. 18, the following describes the gloss mode and the non-gloss mode of the image forming apparatus 100. The image forming apparatus 100 may selectively provide the gloss mode to apply gloss to a fixed toner image T on a sheet P and the non-gloss mode not to apply gloss to a fixed toner image T on another sheet P when both the sheets P have a same basis weight or a same basic weight. For example, the image forming apparatus 100 includes a control panel displaying the gloss mode and the non-gloss mode so that a user can select the gloss mode or the non-gloss mode. The gloss mode uses a sheet having a high gloss in a range from about 30 percent to about 50 percent such as coated paper to form a fixed toner image on the sheet and apply gloss equivalent to gloss of the sheet P serving as a background of the fixed toner image to the fixed toner image. The gloss mode is preferably used for photogravure printing. The non-gloss mode uses a sheet having a low gloss such as plain paper to form a fixed toner image on the sheet and not apply gloss to the fixed toner image. The gloss is measured by a 60-degree glossmeter and denoted in percent.

Figure 21A:
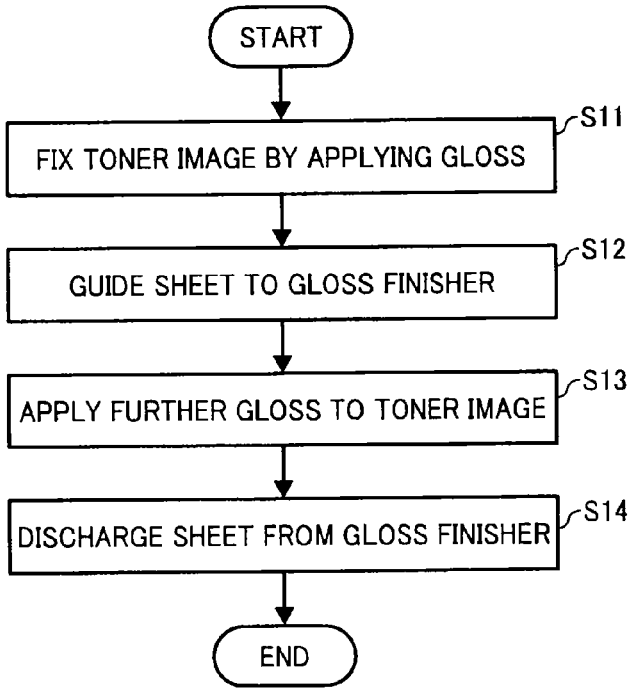
FIG. 21A is a flowchart illustrating processes performed in the image forming apparatus shown in FIG. 1 in a gloss mode.

Referring to FIGS. 18 and 21A, the following describes processes performed when the gloss mode is selected, and a sheet such as coated paper having the gloss in the range from about 30 percent to about 50 percent is used. FIG. 21A is a flowchart illustrating processes performed in the image forming apparatus 100 in the gloss mode.

In step S11, a sheet P bearing an unfixed toner image T is sent to the fixing device 5, and the fixing device 5 fixes the toner image T on the sheet P. Specifically, the fixing belt 11 is heated up to a proper fixing temperature by heat generated by the heater 15*h* provided inside the heating roller 15. The cam 78 of the pressure adjuster 70 is moved to adjust nip pressure applied at the nip portion N1 so that a region in which nip pressure in a range from about 15 N/cm$^2$ to about 30 N/cm$^2$ is applied occupies 50 percent or more of the whole nip portion N1. Accordingly, the toner image T on the sheet P passing through the fixing device 5 is fixed on the sheet P properly, and a gloss of 25 percent or more is applied to the fixed toner image T.

In step S12, the guide 45 corrects curl of the sheet P discharged from the fixing device 5, and guides the sheet P so that a leading edge of the sheet P enters the gloss finisher 6 properly.

In step S13, the gloss finisher 6 applies further gloss to the fixed toner image T on the sheet P. Specifically, the surface temperature of the heating roller 80 is in a range from about 80 degrees centigrade to about 100 degrees centigrade. The pressure adjuster 91 adjusts nip pressure applied at the nip portion N2 to a range from about 15 N/cm$^2$ to about 30 N/cm$^2$. Accordingly, when the sheet P passes through the gloss finisher 6, heat and predetermined pressure are applied to the fixed toner image T on the sheet P at the nip portion N2 to level a surface layer of the fixed toner image T. A gloss within plus and minus 15 percent with respect to the gloss of the sheet P, preferably a gloss within plus and minus 10 percent, is applied to the fixed toner image T on the sheet P.

In step S14, the sheet P bearing the fixed toner image T is discharged from the gloss finisher 6, and passes through the guide 95 and the conveyance roller pair 7 provided on the conveyance path.

Figure 21B:
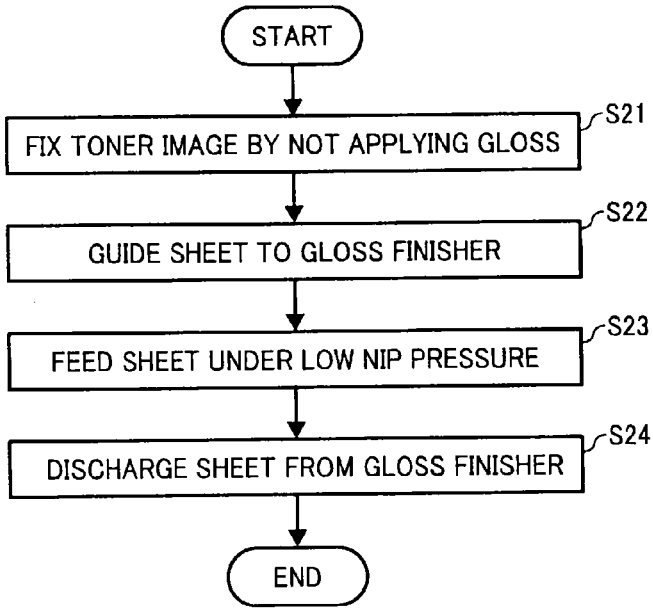
FIG. 21B is a flowchart illustrating processes performed in the image forming apparatus shown in FIG. 1 in a non-gloss mode for a sheet having a length smaller than 210 mm.

Referring to FIGS. 18 and 21B, the following describes processes performed when the non-gloss mode is selected. FIG. 21B is a flowchart illustrating processes performed in the image forming apparatus 100 in the non-gloss mode. Size of a sheet P is checked and identified as a sheet having the length smaller than 210 mm or a sheet having the length not smaller than 210 mm in the sheet conveyance direction.

The following describes processes performed when the sheet P is identified as a sheet having the length smaller than 210 mm in the sheet conveyance direction.

In step S21, a sheet P bearing an unfixed toner image T is sent to the fixing device 5, and the fixing device 5 fixes the toner image T on the sheet P. Specifically, the fixing belt 11 is heated up to a proper fixing temperature by heat generated by the heater 15*h* provided inside the heating roller 15. The cam 78 of the pressure adjuster 70 is moved to adjust nip pressure applied at the nip portion N1 so that a region in which nip pressure in a range from about 15 N/cm$^2$ to about 30 N/cm$^2$ is applied occupies less than 50 percent of the whole nip portion N1. Accordingly, the toner image T on the sheet P passing through the fixing device 5 is fixed on the sheet P properly in a state in which the gloss of the fixed toner image T on the sheet P is hardly increased. Alternatively, conditions of the fixing device 5 in the non-gloss mode may be equivalent to conditions of the fixing device 5 in the gloss mode according to sheet type.

In step S22, the guide 45 corrects curl of the sheet P discharged from the fixing device 5, and guides the sheet P so that a leading edge of the sheet P enters the gloss finisher 6 properly.

In step S23, the gloss finisher 6 sandwiches the sheet P at the nip portion N2 and feeds the sheet P. Specifically, the surface temperature of the heating roller 80 is in a range from about 80 degrees centigrade to about 100 degrees centigrade. The pressure adjuster 91 adjusts nip pressure applied at the nip portion N2 to a level lower than the nip pressure applied at the nip portion N2 in the gloss mode, for example, to a value not greater than 5 N/cm$^2$. Under such low nip pressure, when the sheet P passes through the gloss finisher 6, heat and pressure are hardly applied to the fixed toner image T on the sheet P at the nip portion N2, not increasing the gloss of the fixed toner image T.

In step S24, the sheet P bearing the fixed toner image T is discharged from the gloss finisher 6, and passes through the guide 95 and the conveyance roller pair 7 provided on the conveyance path.

Figure 21C:
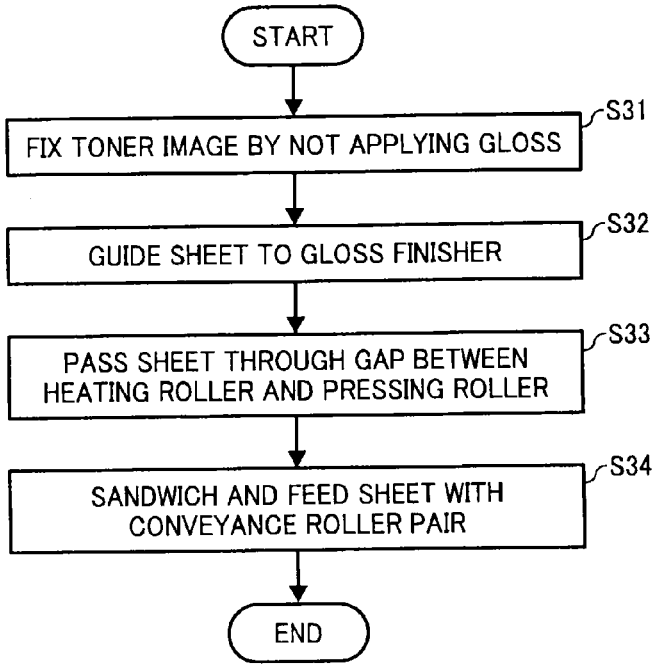
FIG. 21C is a flowchart illustrating processes performed in the image forming apparatus shown in FIG. 1 in a non-gloss mode for a sheet having a length not smaller than 210 mm.

Referring to FIGS. 18 and 21C, the following describes processes performed when the non-gloss mode is selected. FIG. 21C is a flowchart illustrating processes performed in the image forming apparatus 100 in the non-gloss mode. The following describes processes performed when the sheet P is identified as a sheet having the length not smaller than 210 mm in the sheet conveyance direction.

In step S31, a sheet P bearing an unfixed toner image T is sent to the fixing device 5, and the fixing device 5 fixes the toner image T on the sheet P. Specifically, the fixing belt 11 is heated up to a proper fixing temperature by heat generated by the heater 15*h* provided inside the heating roller 15. The cam 78 of the pressure adjuster 70 is moved to adjust nip pressure applied at the nip portion N1 so that a region in which nip pressure in a range from about 15 N/cm$^2$ to about 30 N/cm$^2$ is applied occupies less than 50 percent of the whole nip portion N1. Accordingly, the toner image T on the sheet P passing through the fixing device 5 is fixed on the sheet P properly in a state in which the gloss of the fixed toner image T on the sheet P is hardly increased.

In step S32, the guide 45 corrects curl of the sheet P discharged from the fixing device 5, and guides the sheet P so that a leading edge of the sheet P enters the gloss finisher 6 properly.

In step S33, the sheet P passes through a roller gap not greater than 2 mm, which is formed between the heating roller 80 and the pressing roller 90 by separating the pressing roller 90 from the heating roller 80.

In step S34, the sheet P bearing the fixed toner image T is discharged from the gloss finisher 6 and passes through the guide 95, and reaches the conveyance roller pair 7. The conveyance roller pair 7 is disposed within 210 mm from the exit of the nip portion N1 of the fixing device 5. Therefore, the leading edge of the sheet P reaches the conveyance roller pair 7 before a trailing edge of the sheet P leaves the nip portion N1. Thus, the conveyance roller pair 7 sandwiches and feeds the sheet P properly. The sheet P discharged from the conveyance roller pair 7 is sent to the output device 8 (depicted in FIG. 1) through the conveyance path.

As described above, when the length of the sheet P in the sheet conveyance direction is smaller or not smaller than 210 mm in the non-gloss mode (e.g., a normal print mode), the fixing device 5 and the gloss finisher 6 convey the sheet P stably without increasing the gloss of the toner image T. Accordingly, the toner image T having a desired gloss can be formed without changing the path line PL in either the gloss mode or the non-gloss mode, resulting in the compact image forming apparatus 100.

In the gloss mode, a nip time of the fixing device 5 for nipping the sheet P may be set to not smaller than 30 msec or preferably not smaller than 60 msec. A nip time of the gloss finisher 6 may be set to not smaller than 15 msec. Accordingly, even in the gloss mode, productivity equivalent to productivity provided in the non-gloss mode can be provided. In other words, the image forming apparatus 100 can provide high productivity in either the gloss mode or the non-gloss mode.

Figure 22:
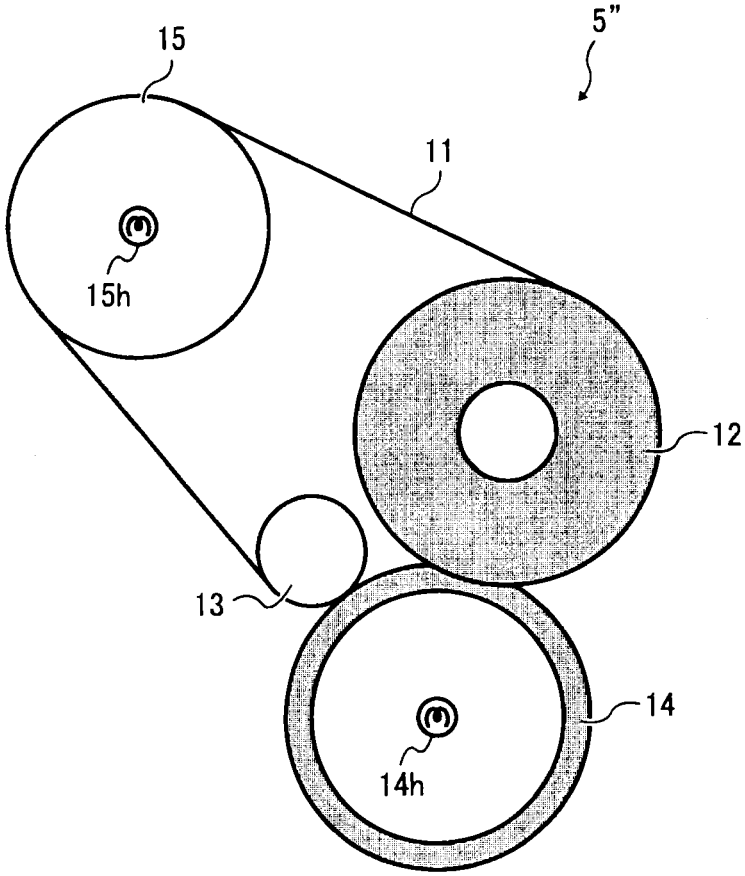
FIG. 22 is a sectional view of a fixing device according to yet another exemplary embodiment of the present invention.

Referring to FIG. 22, the following describes a fixing device 5" as a modified example of the fixing device 5 depicted in FIG. 2 or the fixing device 5' depicted in FIG. 4. FIG. 22 is a sectional view of the fixing device 5". The fixing device 5" does not include the tension roller 16 and the driven roller 17 depicted in FIG. 2 or the support roller 16' depicted in FIG. 4. The other elements of the fixing device 5" are equivalent to the elements of the fixing device 5 or 5'.

As another modified example, the above-described exemplary embodiments may be applied to an image forming apparatus not including the gloss finisher 6 depicted in FIG. 18.

As yet another modified example, the above-described exemplary embodiments may be applied to an image forming apparatus including a second fixing device replacing the gloss finisher 6 depicted in FIG. 18. Specifically, the second fixing device includes a second nip portion at which heat and pressure are applied to a toner image on a sheet. Namely, two fixing devices, which are the fixing device 5 depicted in FIG. 18 and the second fixing device, fix the toner image on the sheet.

The fixing device 5 depicted in FIG. 3 may include the support roller 16' depicted in FIG. 9A instead of the tension roller 16 and the driven roller 17 to provide the above-described effects provided by the fixing device 5' depicted in FIG. 9A. Similarly, the fixing device 5' may include the tension roller 16 and the driven roller 17 instead of the support roller 16' to provide the above-described effects provided by the fixing device 5.

As described above, the image forming apparatus 100 depicted in FIG. 1 provides improved fixing and gloss application functions. In other words, the image forming apparatus 100 can form a toner image with gloss or without gloss on various types of sheets (e.g., a thin sheet or a thick sheet, and plain paper or coated paper) without degrading productivity.

According to the above-described exemplary embodiments, in the fixing device 5, 5', or 5" depicted in FIG. 3, 4, or 22, respectively, roller hardnesses of the fixing roller 12, the separation roller 13, and the pressing roller 14 have a proper relation. Accordingly, the fixing roller 12 is deformed to have a concave shape by pressure applied by the pressing roller 14, and presses the fixing belt 11 against the pressing roller 14. Similarly, the separation roller 13 is deformed to have a concave shape by pressure applied by the pressing roller 14, and presses the fixing belt 11 against the pressing roller 14. Consequently, the fixing belt 11 is pressed against the pressing roller 14 with a substantial force at positions upstream and downstream from the intermediate nip region I of the nip portion N1. Accordingly, the fixing belt 11 is pressed against the pressing roller 14 in such a manner that the fixing belt 11 is not separated from the pressing roller 14 at the intermediate nip region I. As a result, the fixing device 5, 5', or 5" can prevent or reduce shifting of a toner image formed on a sheet and fluctuation in heat applied to the sheet while maintaining proper releasing property for releasing the sheet from the fixing belt 11 and the pressing roller 14. Further, the fixing device 5, 5', or 5" can prevent or reduce twisting of the fixing belt 11, providing proper movement of the fixing belt 11.

In the fixing device 5 depicted in FIG. 15A, the fixing belt unit 11U including the fixing belt 11, the fixing roller 12, and the separation roller 13, and the pressing roller 14 are driven by the first motor 11*m* and the second motor 14*m* serving as separate drivers, respectively. Accordingly, the first motor 11*m* and the second motor 14*m* adjust the circumferential velocities of the fixing belt unit 11U and the pressing roller 14, respectively.

As illustrated in FIGS. 16D and 16E, the one-way clutches 18*a* and 22*a* are provided in the first transmission 11*t* of the first driving system 11*s*. Accordingly, even when the circumferential velocity of the pressing roller 14 is greater than the circumferential velocities of the fixing roller 12 and the separation roller 13, respectively, the fixing roller 12 and the separation roller 13 rotate in accordance with rotation of the pressing roller 14. Consequently, a relative difference between the circumferential velocities of the fixing belt unit 11U and the pressing roller 14 at the nip portion N1 decreases to prevent formation of a faulty fixed toner image such as a scratched toner image or an orange peel toner image.

As illustrated in FIG. 15A, when the circumferential velocity of the fixing belt unit 11U is smaller than the circumferential velocity of the pressing roller 14, the motor controller 200 depicted in FIG. 15B adjusts the number of rotations of the first motor 11*m* to cause the circumferential velocity of the fixing belt unit 11U to be equivalent to the circumferential velocity of the pressing roller 14. Accordingly, a decreased load is applied to the pressing roller 14. Thus, the relative difference between the circumferential velocities of the fixing belt unit 11U and the pressing roller 14 may not generate easily.

Similarly, in the fixing device 5' or 5" depicted in FIG. 9A or 22, respectively, the fixing roller 12 and the pressing roller 14 are driven by the first motor 12*m* and the second motor 14*m'* serving as separate drivers, respectively. Accordingly, the first motor 12*m* and the second motor 14*m'* adjust the circumferential velocities of the fixing roller 12 and the pressing roller 14, respectively, providing effects equivalent to the above-described effects provided by the fixing device 5.

The image forming apparatus 100 includes the fixing device 5, 5', or 5" depicted in FIG. 3, 4, or 22, respectively. The fixing device 5, 5', or 5" can prevent formation of a faulty toner image due to deformation of the intermediate nip region I of the nip portion N1 even when various types of sheets are used or sheets are conveyed in various states. Thus, the image forming apparatus 100 can form a toner image stably. As illustrated in FIG. 18, the gloss finisher 6 is provided downstream from the fixing device 5 in the sheet conveyance direction to adjust the gloss of the toner image. In the gloss finisher 6 also, the driving controls according to the above-described exemplary embodiments may be performed to prevent or reduce formation of a faulty toner image and creases of the sheet.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, the fixing device comprising:

a fixing roller comprising a first elastic layer as a surface layer and having a roller hardness A;

a separation roller provided downstream from the fixing roller in a recording medium conveyance direction and having a diameter smaller than a diameter of the fixing roller, the separation roller comprising a second elastic layer as a surface layer and having a roller hardness B smaller than the roller hardness A of the fixing roller;

an endless fixing belt wound around at least the fixing roller and the separation roller; and a pressing roller pressed against the fixing roller and the separation roller via the fixing belt to form a nip portion between the fixing belt and the pressing roller through which the recording medium bearing the toner image passes, the pressing roller comprising a third elastic layer as a surface layer and having a roller hardness C not smaller than the roller hardness A of the fixing roller.

2. The fixing device according to claim 1, wherein the pressing roller drives and rotates the fixing belt.

3. The fixing device according to claim 1, wherein the separation roller applies tension to the fixing belt wound around the fixing roller and the separation roller.

4. The fixing device according to claim 1, wherein the third elastic layer of the pressing roller includes an elastic material identical to an elastic material of the first elastic layer of the fixing roller, and has a thickness smaller than a thickness of the first elastic layer of the fixing roller, and wherein the second elastic layer of the separation roller includes a material having a hardness smaller than a hardness of the elastic material of the first elastic layer of the fixing roller.

5. The fixing device according to claim 1, further comprising:

a pressure adjuster to contact the pressing roller to move the pressing roller with respect to the fixing roller to adjust a length of the nip portion formed between the fixing belt and the pressing roller in the recording medium conveyance direction; and a biasing member connected to the fixing roller and the separation roller to move the separation roller in accordance with movement of the fixing roller caused by the pressing roller moved by the pressure adjuster.

6. The fixing device according to claim 1, further comprising:

a first motor connected to the fixing roller to drive and rotate the fixing roller;

a second motor separate from the first motor and connected to the pressing roller to drive and rotate the pressing roller; and a motor controller connected to the first motor and the second motor to control at least one of the first motor and the second motor to adjust a circumferential velocity of the fixing belt driven by the rotating fixing roller to a velocity not greater than a circumferential velocity of the pressing roller.

7. The fixing device according to claim 6, wherein the motor controller comprises:

a second motor detector to detect a torque of the second motor; and a first motor regulator to adjust an RPM of the first motor based on the torque of the second motor detected by the second motor detector.

8. The fixing device according to claim 7, wherein the first motor regulator increases and decreases the RPM of the first motor by a predetermined RPM with respect to a reference RPM X to determine which of the increased RPM and the decreased RPM of the first motor provides a smaller torque value Y of the second motor, and the first motor regulator changes the reference RPM X to the RPM of the first motor corresponding to the smaller torque value Y by a predetermined RPM repeatedly until the torque value Y of the second motor detected by the second motor detector is at a minimum.

9. The fixing device according to claim 6, wherein the motor controller further comprises a calculator to calculate a ratio between an RPM of the first motor and an RPM of the second motor based on a pressing condition of the pressing roller pressed against the fixing roller.

10. The fixing device according to claim 6, wherein the motor controller further comprises a calculator to calculate a ratio between an RPM of the first motor and an RPM of the second motor based on thickness or type of the recording medium.

11. The fixing device according to claim 1, further comprising:

a support roller around which the fixing belt is wound;

a guide provided at one end of the support roller in an axial direction of the support roller to guide the support roller in a predetermined direction;

a fixing belt detector provided near the fixing belt to detect twisting of the fixing belt; and a support roller motor connected to the support roller, the support roller motor moving the one end of the support roller in the axial direction of the support roller along the guide in the predetermined direction when the fixing belt detector detects twisting of the fixing belt.

* * * * *